US005905468A

United States Patent [19]

Ikawa et al.

[11] Patent Number: 5,905,468

[45] Date of Patent: May 18, 1999

[54] GLASS ANTENNA DEVICE FOR VEHICLES

[75] Inventors: Koji Ikawa; Fuminori Watanabe, both of Yokohama, Japan

[73] Assignee: Asahi Glass Company Ltd., Tokyo, Japan

[21] Appl. No.: 08/701,012

[22] Filed: Aug. 21, 1996

[30] Foreign Application Priority Data

Aug. 23, 1995 [JP] Japan ..... 7-215073

[51] Int. Cl.[6] ..... H01Q 1/32

[52] U.S. Cl. ..... 343/713; 343/704

[58] Field of Search ..... 343/711, 713, 343/712, 704; H01Q 1/32, 21/30

[56] References Cited

U.S. PATENT DOCUMENTS

| | | | |
|---|---|---|---|
| 4,791,426 | 12/1988 | Lindenmeier et al. | 343/713 |
| 5,012,255 | 4/1991 | Becker | 343/713 |
| 5,029,308 | 7/1991 | Lindenmeier et al. | 343/713 |
| 5,083,134 | 1/1992 | Saitou et al. | 343/713 |
| 5,285,048 | 2/1994 | Nakase | 343/713 |
| 5,334,988 | 8/1994 | Marakami et al. | 343/704 |
| 5,719,585 | 2/1998 | Tabata et al. | 343/713 |

*Primary Examiner*—Hoanganh Le
*Assistant Examiner*—Tho Phan
*Attorney, Agent, or Firm*—Oblon, Spivak, McClelland, Maier & Neustadt, P.C.

[57] ABSTRACT

A glass antenna device for a vehicle includes a glass sheet to be fitted to a window opening of a vehicle, which has a first antenna conductor for a low receiving frequency band and a second antenna conductor for a high receiving frequency band arranged thereon; a first coil connected between the first antenna conductor and the second antenna conductor, the first coil having an inductance value which exhibits low impedance in at least the low receiving frequency band; wherein the first coil cooperates with a first other element to generate first resonance so that the first resonance has a resonant frequency existing in a lower frequency band region than the high receiving frequency band.

21 Claims, 13 Drawing Sheets

FIGURE 28 *PRIOR ART*

GLASS ANTENNA DEVICE FOR VEHICLES

BACKGROUND OF THE INVENTION

1. Field of the Invention

The present invention relates to a glass antenna device for vehicles which is suitable for a receiving set on a vehicle, and which is used for receiving signals in radio broadcast, TV broadcast, telephone communication and satellite communication or the like.

2. Discussion of Background

There has been known a glass antenna device (a first conventional glass antenna device) which, as shown in FIG. 28, includes a glass sheet 31 for an automobile rear window, an electric heating type defogger 33 arranged on the glass sheet and having heater strips 32 and bus bars for supplying power to the heater strips 32, an antenna conductor 136 which is capacitively coupled to the defogger 33 in proximity thereto so as to make transmission of a direct current therebetween and to prevent transmission of a high frequency current therebetween, and a choke coil 139 connected between the bus bars and a d.c. power source 10 for the defogger 33.

In the first conventional glass antenna device, the choke coil 139 is inserted between the bus bars and the d.c. power source 10 to increase impedance of the choke coil 139 in a high frequency band region such as a broadcast frequency region, thereby allowing a direct current to flow from the d.c. power source 10 to the defogger 33 and preventing currents in the broadcast frequency band region from flowing.

By this arrangements the choke coil 139 can isolate the defogger 33 from a vehicle body ground in terms of high frequencies, and prevent high frequency received current induced in the defogger 33 from flowing to the vehicle body ground, thereby transmitting the high frequency received current to a receiving set 20 in their entireties.

As a conventional glass antenna device (not shown) other than the one shown in FIG. 28, there has been a glass antenna device (a second conventional glass antenna device) wherein an antenna conductor for an AM broadcast frequency band (hereinbelow, referred to as the AM band) and an antenna conductor for an FM broadcast frequency band (hereinbelow, referred to as the FM band) are separately arranged in a glass sheet for an automobile window in order to improve receiving sensitivity. The second conventional glass antenna devices create a problem in that the antenna conductors occupy large areas to deteriorate a visual field.

In the first conventional glass antenna device, a decrease in inductance due to magnetic saturation has to be avoided in order to interrupt a high frequency current because a high direct current for the defogger 33 flows in the choke coil 139 at tens of amp. As a result, adoption of a special winding structure is normally required.

Since the inductance of the choke coil 139 is normally as large as 0.6–1 mH, and since the value of a d.c. resistance is required to decrease to minimize power loss, the winding of the choke coil 139 has to use a coil having a large diameter.

As explained, when the defogger 33 is used as an antenna to ensure good receiving sensitivity, the provision of the choke coil which has a large structure and which is large-sized and heavy, and measures to avoid receiving sensitivity in the FM band are required, creating problems in that the entire structure of the glass antenna device is complicated and productivity is low.

As to the second conventional glass antenna device, since, in receiving AM broadcast, the antenna conductor for the AM band is used without utilizing the antenna conductor for the FM band, receiving efficiency is low. It has been desired to develop a glass antenna device which can use both antenna conductors to improve receiving sensitivity and receive radio waves efficiently.

SUMMARY OF THE INVENTION

It is an object of the present invention to eliminate the disadvantage of the prior art and to provide a glass antenna device for a vehicle, comprising a glass sheet for a vehicle window, which has a first antenna conductor for a low receiving frequency band and a second antenna conductor for a high receiving frequency band arranged thereon; and a first coil electrically connected between the first antenna conductor and the second antenna conductor, the first coil having an inductance value which exhibits low impedance in at least the low receiving frequency band; wherein the first coil cooperates with a first other element to generate first resonance so that the first resonance has a resonant frequency lower than the high receiving frequency band region.

The present invention also provides a glass antenna device for a vehicle wherein the inductance value of the first coil is set to exhibit high impedance in at least the high receiving frequency band.

The present invention also provides a glass antenna device for a vehicle wherein a second coil is electrically connected between one of the first and second antenna conductors and a vehicle body ground.

The present invention also provides a glass antenna device for a vehicle wherein the second coil cooperates with a second other element to apparently generate second resonance.

The present invention further provides a glass antenna device for a vehicle comprising a glass sheet for a vehicle windows which has an antenna conductor arranged thereon, the antenna conductor being effective in a low receiving frequency band and a high receiving frequency band; a first coil and a capacitor which are electrically connected in parallel being electrically connected between the antenna conductor and a receiving set, a first coil having an inductance value which exhibits low impedance in at least the low receiving frequency band; and the capacitor having a capacitance value which exhibits low impedance in the high receiving frequency band and high impedance in the low receiving frequency band; wherein the first coil cooperates with a first other element to generate first resonance so that the first resonance has a resonant frequency lower than the high frequency band, and an end of the capacitor remote from the antenna conductor is electrically connected to the receiving set by a cable.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 28 is a schematic view of the basic structure of a conventional device.

DESCRIPTION OF THE PREFERRED EMBODIMENTS

Figure 1:
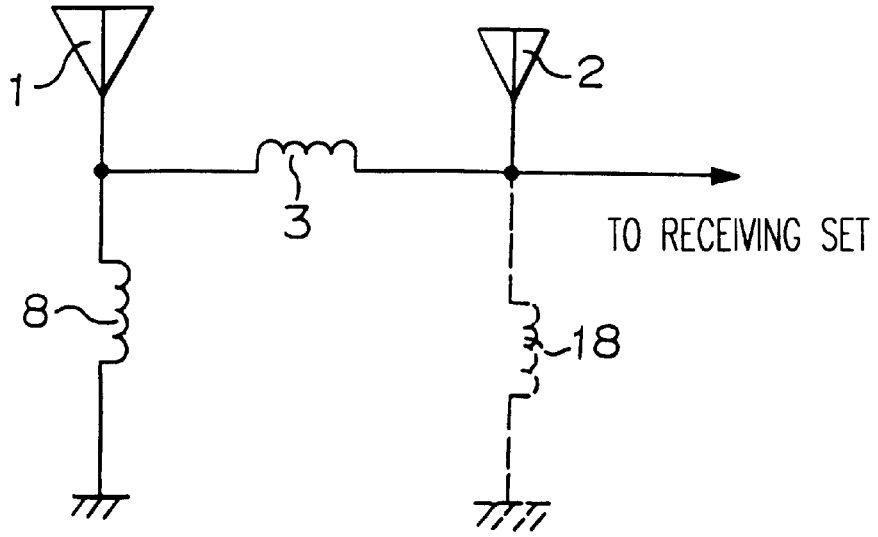
FIG. 1 is a schematic circuit diagram of a basic structure according to the present invention.

Now, the present invention will be described in detail with reference to accompanying drawings. In FIG. 1, there is shown a schematic circuit diagram of a basic structure according to the present invention in order to explain the principle of the present invention.

In FIG. 1, reference numeral 1 designates an antenna conductor for a low receiving frequency band (hereinbelow, referred to as the low band antenna conductor), reference numeral 2 designates an antenna conductor for a high receiving frequency band (hereinbelow, referred to as the high band antenna conductor), reference numeral 3 designates a first coil, reference numeral 8 designates a second coil which is provided as needed, and reference numeral 18 designates a third coil which is provided as needed. In Figures other than FIG. 1, the same reference numerals and symbols as those in FIG. 1 indicate similar or corresponding parts.

Figure 2:
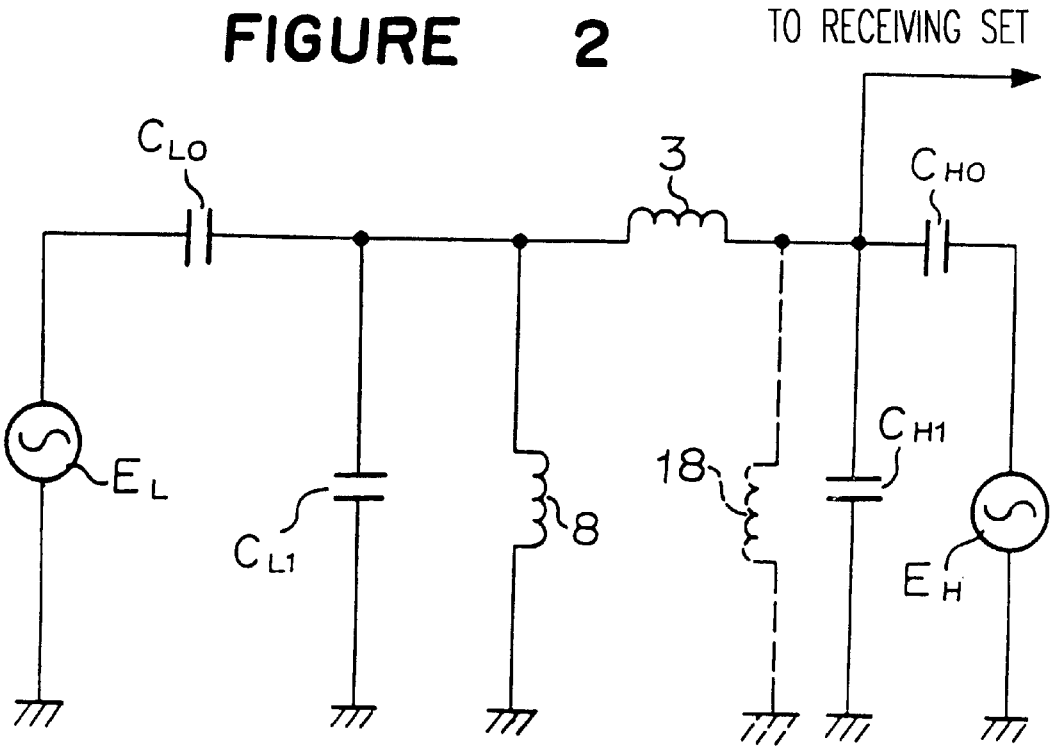
FIG. 2 is an equivalent circuit diagram of FIG. 1.

In FIG. 2, there is shown an equivalent circuit diagram of FIG. 1. In FIG. 2, symbol $E_L$ designates a source of voltage indicative of the low band antenna conductor 1, symbol $E_H$ designates a source of voltage indicative of the high band antenna conductor 2, symbol $C_{L0}$ designates active capacitance of the low band antenna conductor 1, symbol $C_{L1}$ designates floating capacitance (reactive capacitance) of the low antenna conductor 1, symbol $C_{H0}$ designates active capacitance of the high band antenna conductor 2, and symbol $C_{H1}$ designates capacitance (reactive capacitance) as the sum of the floating capacitance of the high band antenna conductor 2 and the floating capacitance of a cable (not shown).

The cable is the one which connects between the high band antenna conductor 2 and a receiving set (not shown). The floating capacitance means electric capacity. In Figures other than FIG. 2, the same reference numerals and symbols as those in FIG. 2 indicate similar or corresponding parts.

Normally, the active capacitance $C_{L0}$ is about one-fifth to about one-tenth the reactive capacitance $C_{L1}$. The active capacitance $C_{H0}$ has little influence on receiving signals in the low receiving frequency band because the active capacitance $C_{H0}$ is about one-tenth the floating capacitance $C_{H1}$. On receiving signals in the low receiving frequency bands an electrical phenomenon about only frequency characteristics such as resonance can be considered on the assumption that the active capacitance $C_{H0}$ is omitted, the active capacitance $C_{H0}$ has opposite ends opened and the source of voltage $E_H$ indicative of the high band antenna conductor 2 is not connected in the circuit in FIG. 2.

In accordance with the present invention, the first coil 3 exhibits low impedance on receiving signals in the low receiving frequency band to connect the low band antenna conductor 1 and the high band antenna conductor 2. As a results the high band antenna conductor 2 can work as a part of the low band antenna conductor 1. Combination of the effective lengths of both the low band antenna conductor 1 and high band antenna conductor 2 can improve receiving sensitivity in the low receiving frequency band region.

The connection according to the present invention means electrical connection. Any circuit element other than the third coil may be connected between the low band antenna conductor 1 and the high band antenna conductor 2 though such an arrangement is not shown in FIG. 1. Examples of such a circuit element are a bypass capacitor and a resistor. The definition of the connection is applicable to the description stated below.

For example, when the low receiving frequency band is an AM broadcast band and the high receiving frequency band is an FM broadcast band, more received radio waves in the AM broadcast band can be received to improve receiving sensitivity in the AM broadcast band because the high band antenna conductor 2 works as a portion of the low band antenna conductor 1 to prolong the effective length of the low band antenna conductor 1 in practice.

It is desirable that the sum of the effective lengths of both the low band antenna conductor 1 and the high band antenna conductor 2 is a length suitable for receiving signals in the low receiving frequency band. As to the first coil 3, a coil of about 1 $\mu$H to about 1 mH is normally used.

Another element which has a function as an inductance component can be used in place of the first coil 3. Even a circuit element which includes an inductance component, and at least one of a capacitance component and a resistance component can be used in place of the first coil if the circuit element includes a component to exhibit high impedance in a wide frequency band from a higher frequency than the low receiving frequency band to the high receiving frequency band.

It is preferable that the first coil 3 exhibits high impedance in the high receiving frequency band to receive signals in the high receiving frequency bands however, the first coil 3 can be used in the high receiving frequency band even if it exhibits high impedance.

The low impedance means impedance which is in such a range that the low band antenna conductor 1 and the high band antenna conductor 2 are connected, and a signal in the low receiving frequency band induced in the low band antenna conductor 1 is easy to flow into the high band antenna conductor 2, and which is normally about 5 times the input impedance at the side of a receiving set or less. The input impedance at the side of the receiving set normally means the input impedance of the receiving set. If an impedance converter is connected between the input of the receiving set and the antenna device, the input impedance at the side of the receiving set means the input impedance of the impedance converter.

The high impedance means impedance which is in such a range that the low band antenna conductor 1 and the high band antenna conductor 2 are not connected, and a signal in the low receiving frequency band induced in the low band antenna conductor 1 is difficult to flow into the high band antenna conductor 2, and which is normally higher than about 5 times the input impedance at the side of the receiving set.

When the low receiving frequency band is AM broadcasts the input impedance at the side of the receiving set is normally 1–10 KΩ on receiving the AM broadcast. For example, if the input impedance at the side of the receiving set is 5 KΩ, impedance not higher than 25 KΩ applies to the low impedances and impedance higher than 25 KΩ applies to the high impedance.

When the high receiving frequency band is FM broadcast, the input impedance at the side of the receiving set is normally 50 or 75 Ω on receiving the FM broadcast. For example, if the input impedance at the side of the receiving set is 50 Ω, impedance not higher than 250 Ω applies to the low impedance, and impedance higher than 250 Ω applies to the high impedance.

The presence of the functions as stated above allows a signal received by the antenna conductor 1 to be transmitted to the first coil 3, and both signals received by the antenna conductor 2 and the antenna conductor 1 to be transmitted to the receiving set on receiving signals in the low receiving frequency band.

In this cases the inductance of the first coil 3 and mainly the reactive capacitance $C_{H1}$ generate series resonance (first resonance). In other words, the first coil 3 and a first other element generate the first resonance. The first other element means that it is not limited to the reactive capacitance $C_{H1}$ but includes an inductance components a capacitance components a resistance component and so on which are artificially or nonartificially applied to the circuit of FIG. 1.

The first resonance as the series resonance introduces parallel resonance by reactance (series resonant reactance) due to the series connection of the first coil 3 and the reactive capacitance $C_{H1}$ and by the reactive capacitance $C_{L1}$, when viewed from the side of the low band antenna conductor.

The parallel resonance can improve in the receiving sensitivity in a desired receiving frequency band region. The first resonance is required to have a resonant frequency existing at a frequency lower than the high receiving frequency band. Presence of the first resonance can improve the receiving sensitivity in the entire low receiving frequency band by normally more than about 5 dB in comparison with absence of the first resonance.

It is desirable that the parallel resonance has a resonant frequency existing in the low receiving frequency band. Presence of the resonant frequency of the parallel resonance in the low frequency band can improve the receiving sensitivity in the entire low receiving frequency band by normal more than about 10 dB in comparison with absence of the resonant frequency of the parallel resonance in the low receiving frequency band.

The explanation with respect to FIGS. 1 and 2 has been made for the case wherein the first resonance is series resonance because it is preferable. However, the first resonance is not limited to series resonance. The first resonance may be parallel resonance by inserting at least one of a coil, a capacitance and a resistor in a predetermined position of the circuits of FIGS. 1 and 2. This arrangement is also applicable to the circuits of the FIGS. 4–6 which will be explained later.

The series resonance is slightly influenced by the floating capacitance of wires which are in the vicinity of the low band antenna conductor 1 and the high band antenna conductor 2. For example, wires such as the first coil 3 and the second coil 8 have floating capacitance which has slight influence on the series resonance.

In the present invention, it is preferable that the low band antenna conductor 1 has the reactive capacitance $C_{L1}$, and that the inductance of the second coil 8 and mainly the reactive capacitance $C_{L1}$ apparently produce parallel resonance (second resonance).

In a word, the second coil 8 cooperates with a second other element to generate the second resonance. The second other element means that it is not limited to the reactive capacitance $C_{L1}$ but includes an inductance components a capacitance components a resistance component and so on which are artificially or nonartificially applied to the circuit of FIG. 1.

Even if the value of the inductance of the second coil 8 and the value of the second other element are set so as to generate the second resonance, the second resonance (hereinbelow, referred as to the apparent second resonance) does not normally generate in practice. In place of the second resonances a pair of resonance (subordinate resonance to the second resonance) generates in a system of the entire circuit shown in FIG. 2. The subordinate resonance is of parallel resonant nature, when viewed from the side of the low band antenna conductor.

The paired subordinate resonance can improve and flatten receiving sensitivity in a desired receiving frequency band. Presence of the subordinate resonance can improve the receiving sensitivity in the entire low receiving frequency band region by normally more than 5 dB in comparison with absence of the subordinate resonance.

The explanation with respect to FIGS. 1 and 2 has been made for the case wherein the second resonance is parallel resonance because it is preferable. However, second resonance is not limited to parallel resonance. The second resonance may be series resonance by inserting at least one of a coil, a capacitor and a resistor into a predetermined position of the circuit of FIGS. 1 and 2. This arrangement is also applicable to the circuits of FIGS. 4–6.

With respect to use of a received signal, the signal at a feeding terminal (not shown in FIGS. 1 or 2) which is connected to the high band antenna conductor 2 is normally transmitted to the receiving set. However, the present invention is not limited to such an arrangement. As long as a signal received in accordance with the present invention can be utilized, a signal at any position of the circuit may be transmitted to the receiving circuit.

The third coil will be described in detail later on.

Figure 3:
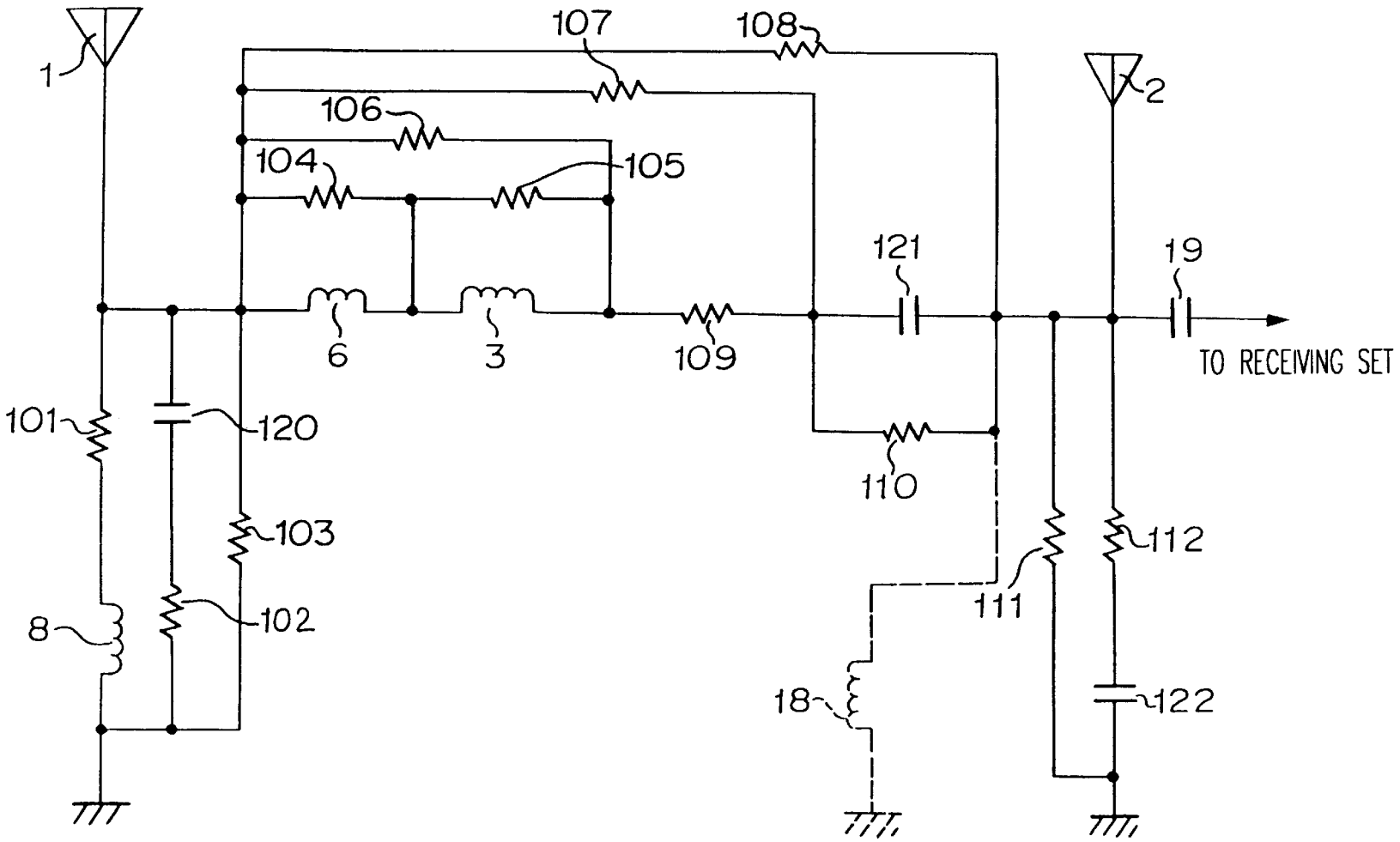
FIG. 3 is a schematic circuit diagram of the structure of an embodiment of the present invention.

In FIG. 3, there is shown a schematic circuit diagram of the structure of an embodiment of the present invention. In FIG. 3, reference numeral 6 designates a high frequency coil, and reference numeral 19 designates a coupling capacitor for direct current isolation. Reference numeral 101, 102, 103, 104, 105, 106, 107, 108, 109, 110, 111 and 112 designate damping resistors. Reference numeral 19, 120, 121 and 122 designate capacitors. In Figures other than FIG. 3, the same reference numerals and symbols as those in FIG. 3 indicate similar or corresponding parts.

In accordance with the present invention, when the high frequency coil 6 is provided and signals in the low receiving frequency band region are received, the low band antenna conductor 1 is connected to the high band antenna conductor 2 because the high frequency coil 6 exhibits low impedance as well as the first coil 3. As the high frequency coil 6, a coil having about 0.1 $\mu$H–about 100 $\mu$H is normally used.

When the high receiving frequency band is not less than 10 Hz, the high frequency coil 6 has inductive impedance and exhibits high impedance in at least the high receiving frequency band and its near region. The high frequency coil 6 can act for the first coil 3 in the high receiving frequency band because normally the first coil 3 has a low self resonant frequency and loses impedance in the high receiving frequency band.

In other words, the high frequency coil 6 provides an inductance component to replenish the inductance component possessed by the first coil 3. The first coil 3 normally exhibits high impedance at a higher frequency than the low receiving frequency band. However, it is designed that the first coil 3 and the the high frequency coil 6 exhibit high impedance in a wide frequency band region covering from the low receiving frequency band region to the high receiving frequency band region because the first coil 3 is difficult to exhibit high impedance in the high receiving band region.

If the first coil 3 can exhibit high impedance in such a wide frequency band region covering the low receiving frequency band region to the high receiving frequency band region by itself, the high frequency coil 6 is unnecessary and can be eliminated.

As the high frequency coil 6, a lead having a suitable length may be used. A solenoid without a magnetic core or a coil with a magnetic core is normally used.

When the high frequency coil 6 is provided, the sum of the inductance of the first coil 3 and that of the high frequency coil 6 provides inductance to generate the first resonance.

The resistors 101, 102, 103, 104, 105, 106, 107, 108, 109, 110, 111 and 112 are damping resistors for adjusting Q (quality factor) for resonance. These resistors may be all provided as required and be eliminated when it is not necessary to adjust Q for resonance.

The respect damping resistors have a function to lessen Q for the first resonance or the second resonance, and normally have a value between tens of Ω—several MΩ. If Q for resonance is small even in absence of the damping resistors, the damping resistors can be eliminated.

Because resistors 101, 102, 103, 104, 105, 106, 107, 108, 109, 110, 111 and 112 have different adjusting elements with respect to Q resonance respectively, at least one of the resistors 101, 102, 103, 104, 105, 106, 107, 108, 109, 110, 111 and 112 is selected and provided as needed in order to obtain desired receiving sensitivity characteristics. The value of the respective resistors may be properly selected and set to obtain the optimum receiving sensitivity characteristics.

The resistors 104, 105, 106, 107, 108, 109 and 110 are ones (damping ones) for adjusting Q which has something to do with the first resonance. Resistors 101, 102 and 103 are ones (damping ones) for adjusting 9 which has something to do with the apparent second resonance.

Capacitors 120, 121 and 122 are ones for assisting resonance or avoiding noise.

When the resonant frequency of the subordinate resonance of the second resonance does not exist in a desired low receiving frequency band region or in the vicinity of the desired low receiving frequency band, or can not attain improvement in receiving sensitivity due to insufficiency in the reactive capacitance $C_{L1}$ of the low band antenna conductor 1, it is preferable that the capacitor 120 is provided to apparently increase the capacitance of the reactive capacitance $C_{L1}$ so as to generate the apparent second resonance having desired characteristics. In other words, the capacitance 120 is used for adjusting the subordinate resonance of the second resonance.

When the resonant frequency of the first resonance does not exist in a desired low receiving frequency band region or in the vicinity of the desired low receiving frequency band, or can not attain improvement in receiving sensitivity due to insufficient in the floating capacitance $C_{H1}$ of the high band antenna conductor 2, it is preferable that the capacitor 122 is provided to apparently increase the capacitance of the floating capacitance $C_{H1}$ so as to generate the first resonance having desired characteristics. In other words, the capacitance 122 is used for adjusting the first resonance. The capacitance 121 is also used for adjusting the first resonances.

The coupling capacitor 19 is used for d.c. voltage isolation to cut a d.c. voltage so as to protect circuit elements and the receiving set. The coupling capacitor is short-circuited in a receiving frequency such as a broadcast frequency. If there is no danger of damaging the circuit elements or the receiving set, the coupling capacitor 19 can be eliminated. The resistors 111 and 112 are ones for adjusting the influence by the capacitor 112.

Referring to FIG. 3, a combination which normally facilitates adjustment will be explained. A first combination is that only the coils 3 and 8, the high frequency coil 6, the resistors 101, 103, and the capacitor 120 are provided. A second combination is that only the coils 3 and 8, the high frequency coil 6, and the resistors 103 and 105 are provided. A third combination is that only the coils 3 and 8, the high frequency coil 6 and the resistor 106 are provided. The first combination is practical and preferable. The second combination and the third combination are preferable in terms of simplification. In these combinations, it may dispense with other coils, capacitors or resistors than the ones just stated. In that case, ones which are connected in parallel with other circuit elements such as the coils are opened, and ones which are connected in series with those are short-circuited.

The third coil 18 is used for generating third resonance, and the third coil is provided when the first resonance and the second resonance can not obtain receiving sensitivity in a sufficient manner. It is preferable that the inductance of the third coil 18 and mainly the reactive capacitance $C_{H1}$ apparently generate parallel resonance (third resonance). The third resonance causes a trio of resonance (subordinate resonance to the third resonance) different from the third resonance to generate in the system of the entire circuit shown in FIG. 2. The subordinate resonance is of parallel resonant nature.

The subordinate resonance of the third resonance can improve receiving sensitivity in a desired receiving frequency band. Presence of the subordinate resonance of the third resonance can improve average receiving sensitivity in the low receiving frequency band by normally more than about 3 dB in comparison with absence of the subordinate resonance.

The explanation with respect to FIGS. 1–3 has been made for the case wherein the third resonance is parallel resonance because it is preferable. However, the third resonance is not limited to parallel resonance. The third resonance may be series resonance by inserting at least one of a coil, a capacitor and a resistor into a predetermined position in the circuits shown in FIGS. 1–3. This arrangement is also applicable to the circuits shown in FIGS. 4–6 which will be explained later on.

Figure 4:
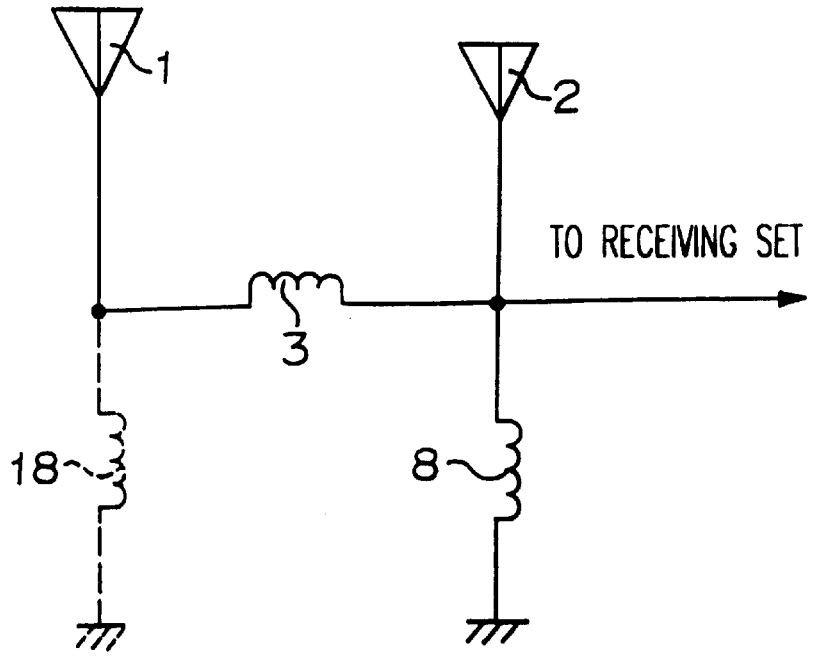
FIG. 4 is a schematic circuit diagram of another basic structure according to the present invention.
Figure 5:
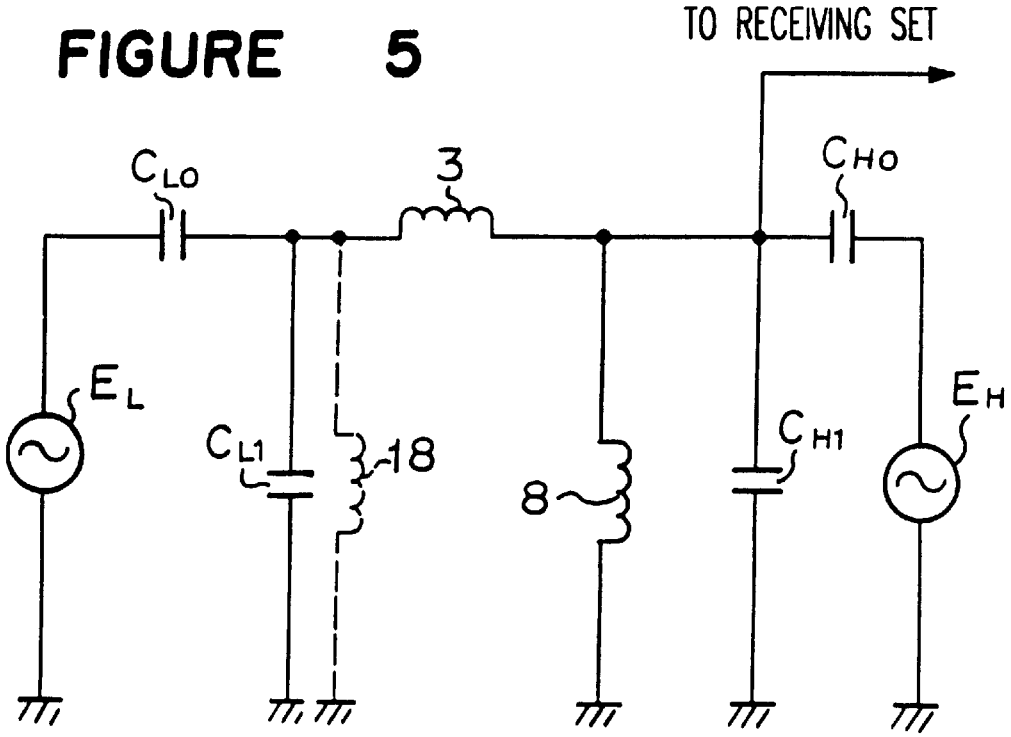
FIG. 5 is an equivalent circuit diagram of FIG. 4.

In FIG. 4, there is shown a circuit diagram showing another basic structure according to the present invention, which is a different type from the one shown in FIG. 1. In FIG. 5, there is shown an equivalent circuit diagram of FIG. 4.

In the embodiment shown in FIG. 4 according to the present invention, the low band antenna conductor 1 and the high band antenna conductor 2 are connected on receiving signals in the low receiving frequency band like in the embodiment shown in FIG. 1 because the first coil 3 exhibits low impedance in that case.

In this case, the inductance of the first coil 3 and mainly the reactive capacitance $C_{H1}$ generate series resonance (the first resonance).

The first resonance as series resonance introduces parallel resonance by reactance (series resonant reactance) due to the series connection of the first coil 3 and the reactive capacitance $C_{H1}$ and by the reactive capacitance $C_{L1}$. The functions and the effects in such a case are the same as the one shown in FIG. 1.

Also in the embodiment shown in FIG. 4 according to the present invention, the low band antenna conductor 1 have reactive capacitance $C_{L1}$ like in the embodiment shown in FIG. 1. It is preferable that the inductance of the second coil 8 and mainly the reactive capacitance $C_{H1}$ apparently generate parallel resonance (the second resonance). When series connection of the parallel connection of the second coil 8 and the reactive capacitance $C_{H1}$, and the first coil 3 is called series combined reactance, occurrence of the second resonance causes subordinate resonance of the second resonance by the series combined reactance and the reactive capacitance $C_{L1}$.

Figure 6:
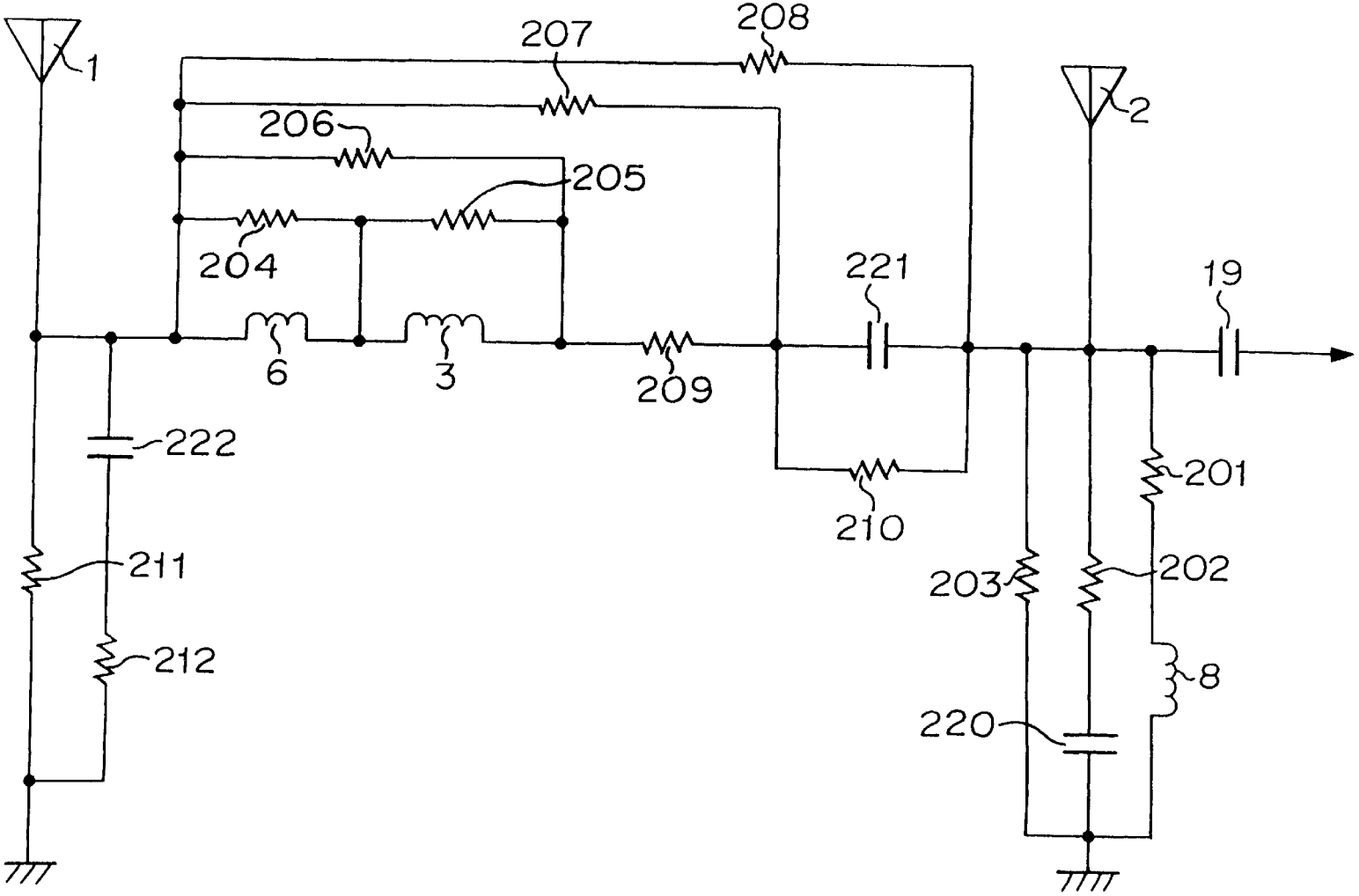
FIG. 6 is a schematic circuit diagram of the structure of an embodiment of the structure shown in FIG. 1.

In FIG. 6, there is shown a circuit diagram showing the structure of the embodiment of FIG. 4. In FIG. 6, reference numeral 6 designates the high frequency coil. Reference numeral 201, 202, 203, 204, 205, 206, 207, 208, 209, 210, 211 and 212 designate damping resistors. Reference numeral 220, 221 and 222 designate capacitors.

The functions and the effects of the high frequency coil 6 in FIG. 6 are the same as the one shown in FIG. 3. The resistors 201, 202, 203, 204, 205, 206, 207, 208, 209, 210, 211 and 212 correspond to the resistors 101, 102, 103, 104, 105, 106, 107, 108, 109, 110, 111 and 112 in FIG. 3. The resistors in FIG. 6 have the same functions and effects as the ones shown in FIG. 3 respectively.

The capacitor 19 is used for direct current isolation. The capacitors 220, 221 and 222 correspond to the capacitors 120, 121 and 122 in FIG. 3.

The function of the high frequency coil 6 in FIG. 6 is the same as that of the high frequency coil 6 in FIG. 3.

In the embodiments shown in FIGS. 1 and 4 according to the present inventions when the first resonance is series resonance and the second resonance is the apparent second resonance, the paired subordinate resonance of the resonance resonance generate as stated earlier.

With respect to the resonant frequency of these paired subordinate resonance of the second resonance, it is preferable that the resonant frequency of one of the subordinate resonance (hereinbelow, referred to as the first subordinate resonant frequency of the second resonance) and the resonant frequency of the remaining subordinate resonance (hereinbelow, referred to as the second subordinate resonant frequency of the second resonance) exist respectively in high and low different frequency regions, having a border line as a substantially center frequency of the low receiving frequency band. These paired subordinate resonance can share a single receiving frequency band so as to divide the band, thereby attaining flat receiving sensitivity characteristics. The flatness in receiving sensitivity means that the difference between the highest receiving sensitivity and the lowest receiving sensitivity is small and flat in a desired band region such as a broadcast frequency band region.

In terms of flatness in the receiving sensitivity, it is particularly preferable that when a maximum frequency of the low frequency band is defined as $f_H$, the first subordinate resonant frequency of the second resonant exists between a frequency of 1.5 times $f_H$ and the substantially center frequency of the low receiving frequency band, and that when a minimum frequency of the low receiving frequency band is defined as $f_L$, the second subordinate resonant frequency of the second resonance exists between a frequency of 0.6 times $f_L$ and the substantially center frequency of the low receiving frequency band. The flatness in receiving sensitivity can not be the best in the low receiving frequency band outside the range stated just above.

For the purpose, when the center frequency of the low receiving frequency band is defined as $f_M$, both the resonant frequency of the first resonance and that of the apparent second resonance are normally made to exist between a frequency of 0.6 times $f_M$ and a frequency of 1.4 times $f_M$.

With respect to the range of the resonant frequency for each resonance, a required range or other factors for the resonant frequency of each resonance can be determined with respect to a short wave, a long wave, an ultrahigh frequency and the like by similar arrangement besides with respect to AM broadcast band (a medium wave) and FM broadcast band.

In order to satisfy the requirements for the range of the resonant frequency of each resonance, the positions of the first resonant frequency, the second resonant frequency and the third resonant frequency are adjusted by changing the first coil 3, the second coil 8, and the third coil 18 and the high frequency coil 6, or providing the capacitors 120, 121 and 122 for connection to replenish the floating capacitance of the low band antenna conductor 1 and the high band antenna conductor 2. This is because the impedance due to mainly the floating capacitance of the low band antenna conductor 1 and the high band antenna conductor 2 is fixed.

The low band antenna conductor 1 and the high band antenna conductor 2 may be arranged in separate window glass sheets. For example, the low band antenna conductor 1 can be arranged in a glass sheet for a rear window, and the high band antenna conductor 2 can be arranged in a glass sheet for a side window. In terms of convenient mounting, it is preferable that both the low band antenna conductor 1 and the high band antenna conductor 2 are a single glass sheet.

As the cable connecting the high band antenna conductor 2 and the receiving set, e.g. a coaxial cable or a feeder is usually used.

With respect to Q for each resonance, it is preferable that the difference between the highest receiving sensitivity and the lowest receiving sensitivity is set in a range of about 1 dB–about 16 dB in the low receiving frequency band region in order to make receiving sensitivity as flat as possible in the low receiving frequency band.

If the difference between the highest receiving sensitivity and the lowest receiving sensitivity is less than about 1 dB, the effect by each resonance is negligible to lower average receiving sensitivity by several dB–tens of dB, which is not preferable. If the difference between the highest receiving sensitivity and the lowest receiving sensitivity is more than about 16 dB, not only variations in the receiving sensitivity widen but also variations in frequency characteristics of the receiving sensitivity for products under mass production widen, which are not preferable.

With respect to the difference between the highest receiving sensitivity and the lowest receiving sensitivity, a more preferable range is from about 2 dB about–13 dB and a particularly preferable range is from about 4 dB–about 10 dB. By putting the difference between the highest receiving sensitivity and the lowest receiving sensitivity in the ranges as just stated the power efficiency from the antenna device constituted by the low band antenna conductor 1 and the high band antenna conductor 2 to the receiving set is made good, and all the high frequency currents of receiving signals which are generated in the antenna device by incoming radio waves can be transmitted to the receiving set, establishing reception with high receiving sensitivity.

Figure 7:
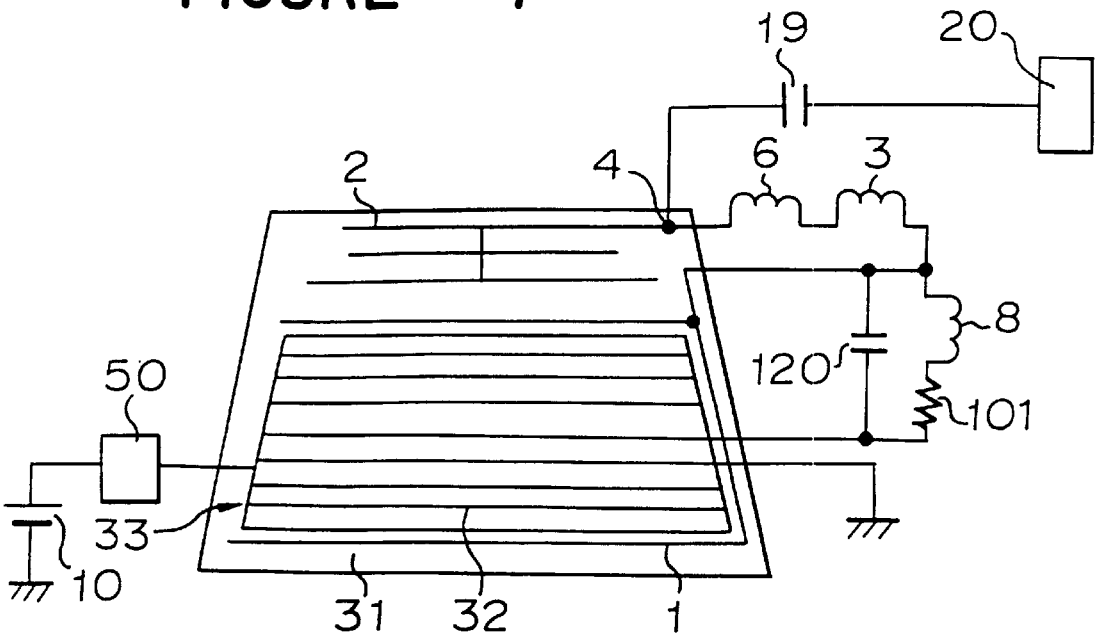
FIG. 7 is a schematic view showing the basic structure of a typical example wherein the present invention is applied to a glass sheet for a rear window.

In FIG. 7, there is shown a schematic view showing the basic structure of a typical example wherein the present invention is applied to an antenna device arranged in a glass sheet for a rear window, on the assumption that the antenna device receives signals in an AM broadcast band, an FM broadcast band, a TV broadcast band and a UHF band.

In FIG. 7, reference numeral 4 designates a feeding terminal, reference 10 designates a direct current source, reference numeral 20 designates a receiving set, reference numeral 31 designates a glass sheet for a rear window, reference numeral 32 designates heater strips, reference numeral 33 designates a defogger as a grounding conductor and reference numeral 50 designates a low-pass filter which is provided as needed.

The low band antenna conductor 1 is used for an AM broadcast band, and a high band antenna conductor 2 is used for an FM broadcast band.

In accordance with the present invention, the low band antenna conductor 1 and the high band antenna conductor 2 are connected on receiving an AM broadcast signal because the first coil 3 and the high frequency coil 6 exhibit low impedance in that case. In this case, the first resonance as series resonance generates.

The high frequency coil 6 has inductive impedance in at least the FM broadcast band and its near region and exhibits high impedance in the FM broadcast band. The high frequency coil 6 acts for the coil 3 in the FM broadcast band because the coil 3 normally has a low self resonant frequency and loses inductance in the FM broadcast band.

It is preferable that the low band antenna conductor 1 is not capacitively coupled to the defogger 33 to prevent signals induced in the low band antenna conductor 1 from leaking to a vehicle ground. The low band antenna conductor 1 and the defogger 33 are normally difficult to be capacitively coupled in a frequency band not higher than 10 MHz if they are separated from each other by 30 mm or more.

It is preferable that when the defogger 33 is provided like the embodiment shown in FIG. 7, there is provided the low-pass filter 50 wherein the low receiving frequency band is a cut-off region. By this arrangement, a noise current due to an engine which overlaps on a direct current source line can be prevented from flowing in the defogger, and receiving sensitivity is raised up to a high degrees thereby improving both the receiving sensitivity and S/N.

Figure 8:
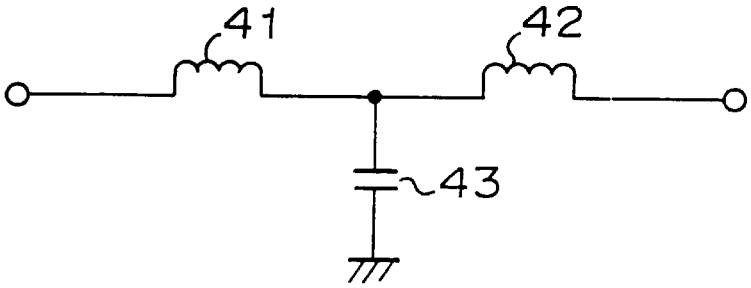
FIG. 8 is a schematic circuit diagram of a typical example of a T type low-pass filter applicable to the example of FIG. 7.

In FIG. 8, there is shown a circuit diagram of a typical example of the low-pass filter 50 which has a T type of filtering structure. In FIG. 8, reference numeral 41 and 42 designate coils, reference numeral 43 designates a capacitor.

Figure 9:
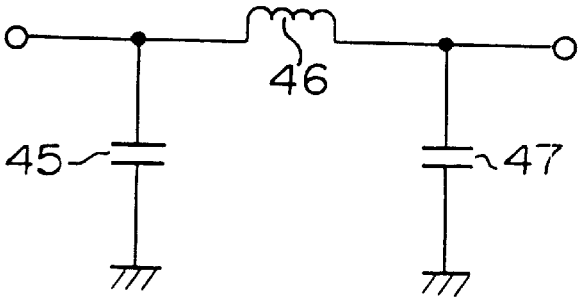
FIG. 9 is a schematic circuit diagram of another type of low-pass filter in place of the one shown in FIG. 8.

In FIG. 9, there is shown a circuit diagram showing another type of the low-pass filter 50 which is different from the one of FIG. 8, and which has a $\pi$ type of filtering structure. In FIG. 8, reference numeral 46 designates a coil, and reference numerals 45 and 47 designate capacitors. It is preferable that the coils 41, 42 and 46 are so thick as to have a diameter of not lower than 1.0 mm, allowing higher currents to flow therein. It is preferable that the coils 41 and 42 have a self resonant frequency of not lower than 60 MHz in order to cut engine noise. It is more preferable that the self resonant frequency is not lower than 80 MHz. Self resonant frequencies of not lower than 60 MHz can improve S/N ratio in receiving frequencies of not higher than 10 MHz by normally several dB in comparison with self resonant frequencies of less than 60 MHz.

It is preferable that the capacitors 43, 45 and 47 are ceramic capacitors from the viewpoint that they have a proper dielectric dissipation factor and high reliability. However, as long as the dielectric dissipation factor is proper and high reliability can be ensured, other kinds of capacitors such as aluminum electrolytic capacitors can be used.

In FIG. 7, the low-pass filter 50 is connected between a left bus bar and the anode of the direct current source 10. However, connection of the low-pass filter is not limited to such arrangement. The low-pass filter 50 may be connected between a right bus bar and the vehicle ground for use. In terms of improved S/N ratio, it is preferable that not only the low-pass filter is connected between the left bus bar and the direct current source 10 but also the low-pass filter is connected between the right bus bar and the vehicle ground.

In FIGS. 10–19 besides FIG. 7, there are shown schematic views of preferred structures of the antenna conductors and the defogger wherein the present invention is applied to an antenna device arranged in a glass sheet for a rear window, on the assumption that the antenna device receives signals in the AM broadcast band, the FM broadcast band, the TV broadcast band and the UHF band.

Figure 10:
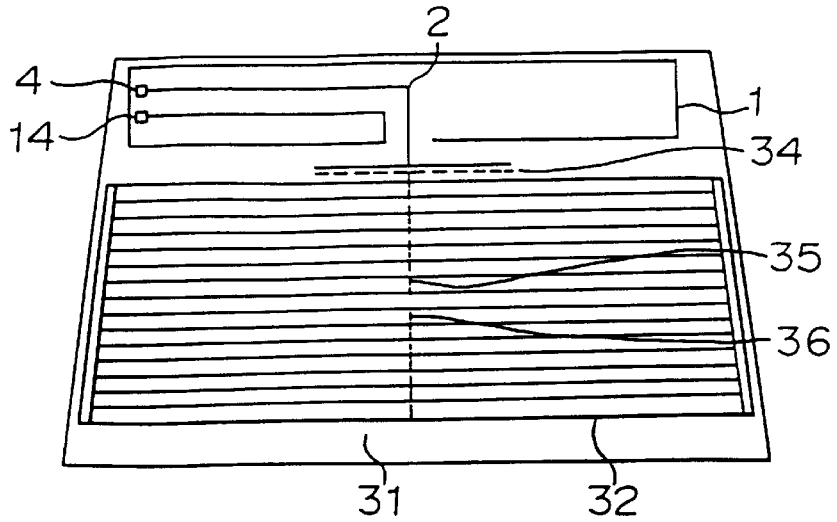
FIG. 10 is a schematic view of an example of antenna conductors and a defogger wherein the present invention is applied to a glass sheet for a rear window.

In FIG. 10, reference numeral 14 designates a feeding terminal for the low band antenna conductor 1, reference numeral 34 designates a capacitive coupling element provided as needed, reference numeral 35 designates a first short-circuit line, and reference numeral 36 designates a second short-circuit line. In Figures other than FIG. 10, the same reference numerals and symbols as the ones in FIG. 10 indicate similar or corresponding parts.

Figure 11:
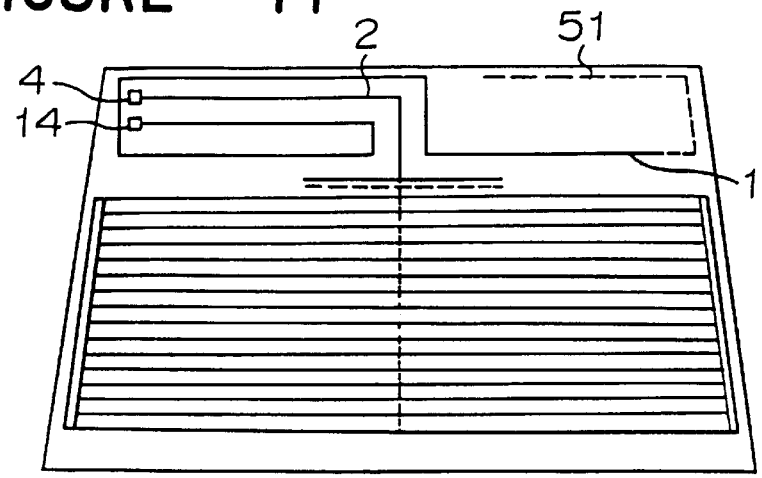
FIG. 11 is a schematic view of another example of the antenna conductors and the defogger which is different from the example of FIG. 10.
Figure 13:
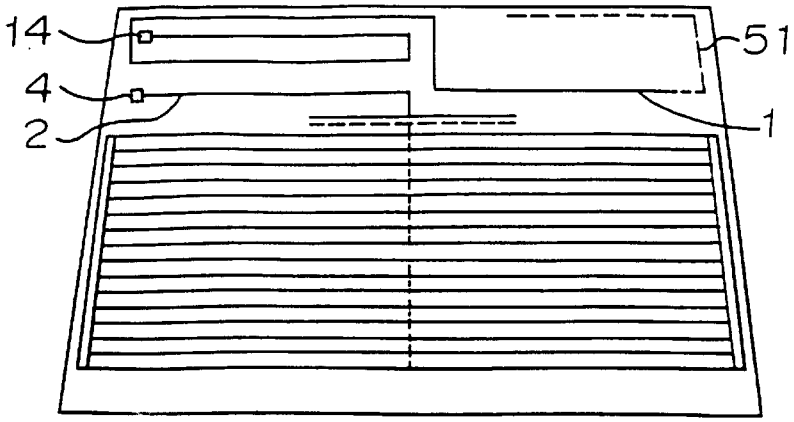
FIG. 13 is a schematic view showing another example of the antenna conductors and the defogger, which is different from the one FIG. 10.
Figure 14:
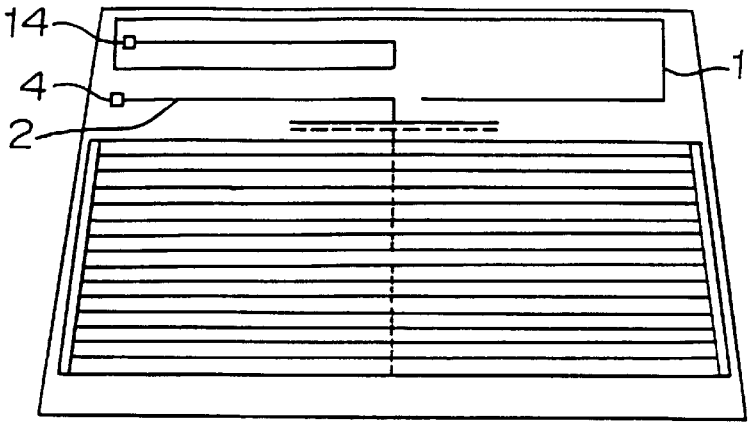
FIG. 14 is a schematic view showing another example of the antenna conductors and the defogger, which is different from the one FIG. 10.
Figure 15:
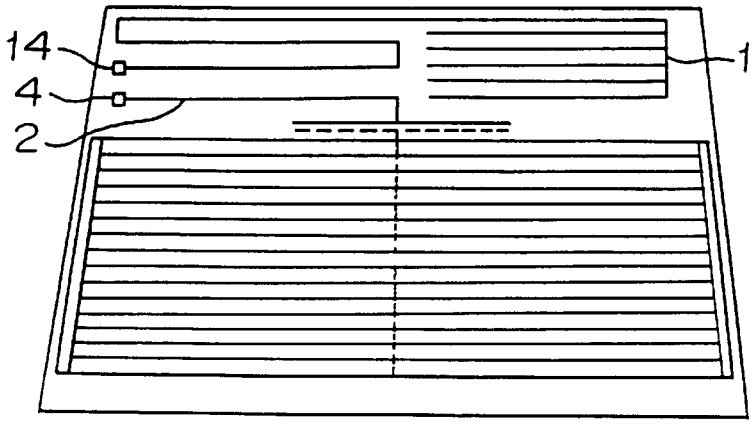
FIG. 15 is a schematic view showing another example of the antenna conductors and the defogger, which is different from the one FIG. 10.

In FIGS. 11 and 13, reference numeral 51 designates an extension element for the low band antenna conductor 1, which is provided as needed. In FIG. 13, a vertical portion of the low band antenna conductor 1 which extends from upward to downward in the vicinity of a substantially center in the width direction of the glass sheet may have one or plurality of annexing elements arranged therefrom in the right direction.

Figure 12:
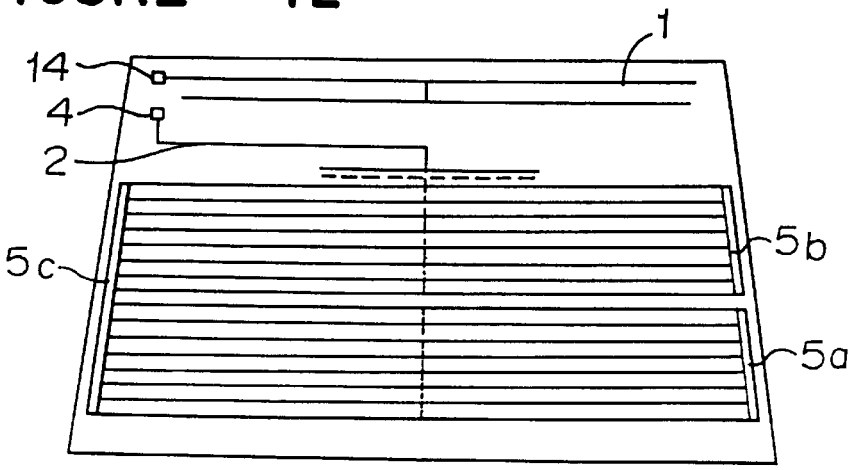
FIG. 12 is a schematic view showing another example of the antenna conductors and the defogger, which is different from the one FIG. 10.

In FIG. 12, reference numerals 5*a*, 5*b* and 5*c* designates bus bars.

Figure 16:
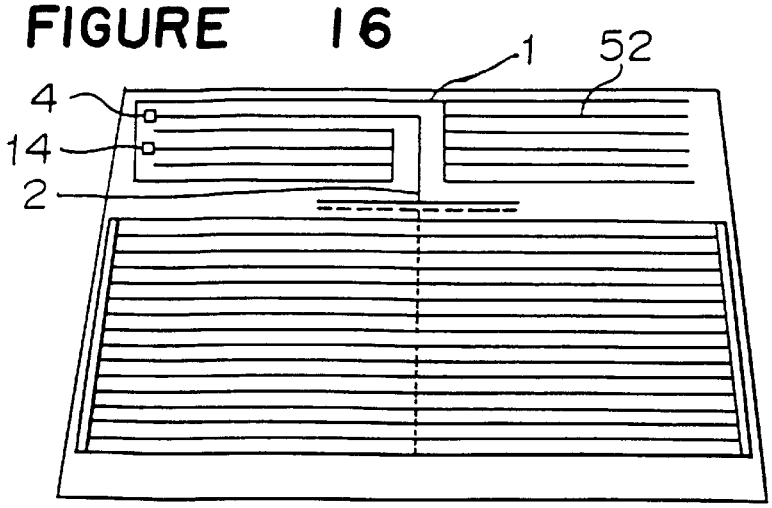
FIG. 16 is a schematic view showing another example of the antenna conductors and the defogger, which is different from the one FIG. 10.

In FIG. 16, reference numeral 52 designates annexing elements for the low band antenna conductor 1, which are arranged as needed.

Figure 17:
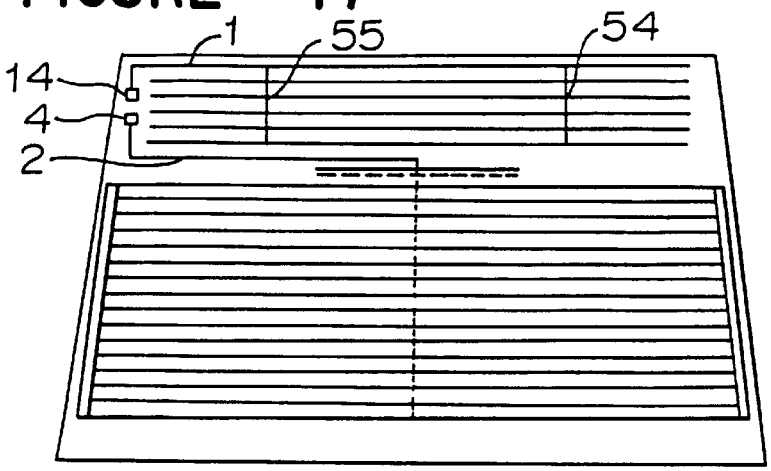
FIG. 17 is a schematic view showing another example of the antenna conductors and the defogger which is different from the one FIG. 10.
Figure 18:
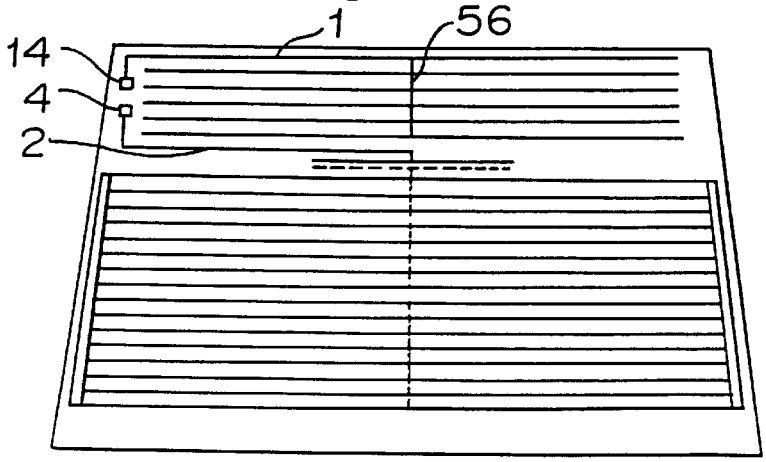
FIG. 18 is a schematic view showing another example of the antenna conductors and the defogger, which is different from the one FIG. 10.

In FIG. 17 reference numerals 54 and 55 designate connecting elements for the low band antenna conductor 1 which are arranged as needed. In FIG. 18 reference numeral 56 designates a connecting element for the low band antenna conductor 1, which is arranged as needed.

Figure 19:
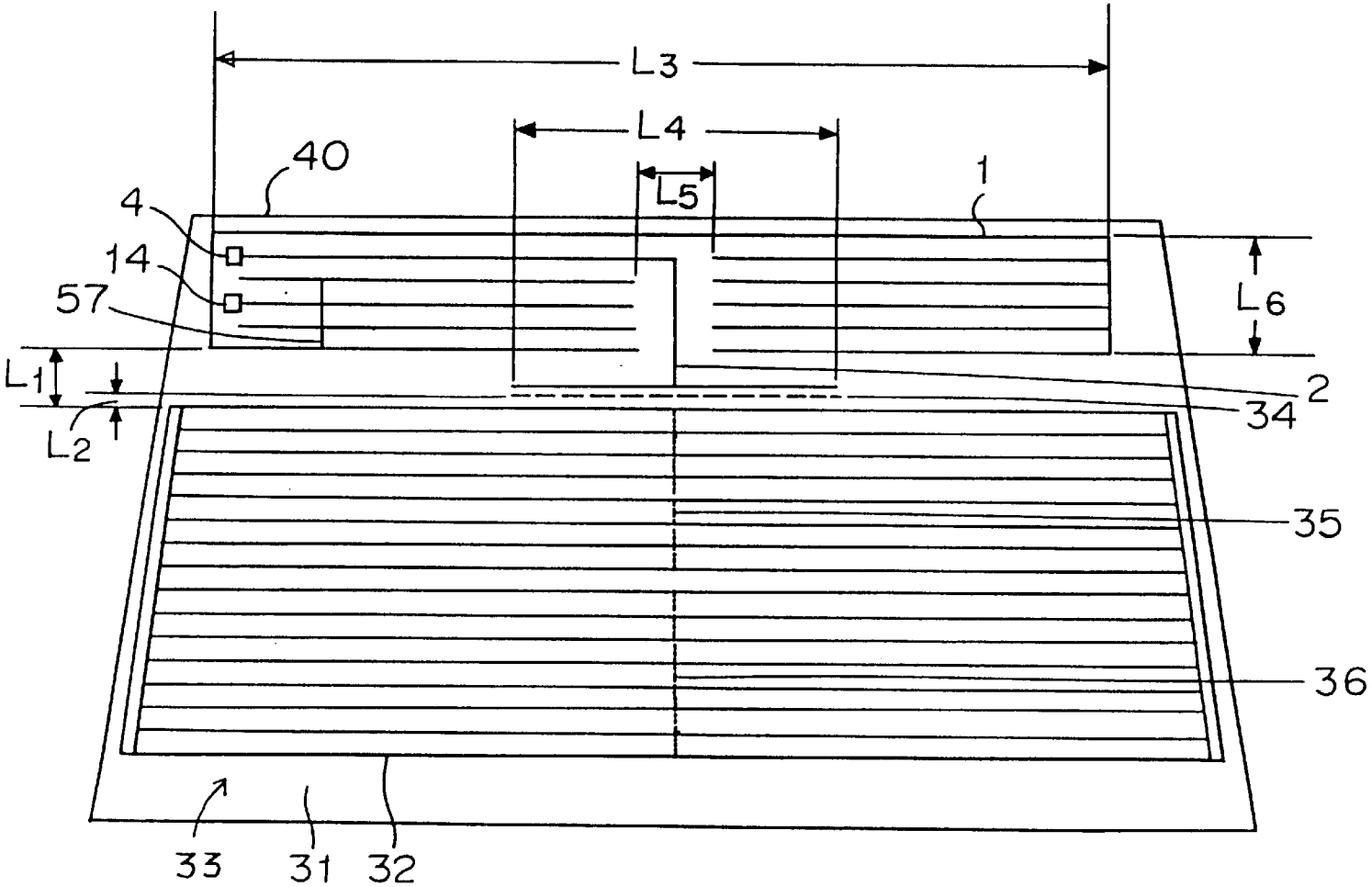
FIG. 19 is a schematic view showing another example of the antenna conductors and the defogger, which is different from the one FIG. 10.

In FIG. 19, reference numeral 40 designates an opening in a vehicle, and reference numeral 57 designates a connecting element for the low band antenna conductor 1, which is arranged as needed. Symbols $L_1$, $L_2$, $L_3$, $L_4$, $L_5$ and $L_6$ designate distance between the elements.

In the structure of the antenna conductors and the defogger shown in FIGS. 10–19, the high band antenna conductor 2 has a portion or most portions thereof arranged between the low band antenna conductor and the defogger, which is preferable. It is more preferable that most portions of the high band antenna conductor are arranged between the low band antenna conductor and the defogger.

Such arrangement can not only ensure a required occupied area for the low band antenna conductor 1 but also can facilitate impedance matching between the high band antenna conductor 2 and the receiving set. This arrangement can improve the receiving sensitivity of the high band antenna conductor 2 by normally more than about 2 dB in comparison with each of such arrangement.

A vertical portion of the high band antenna conductor 2 is separate from the vertical portion of the low band antenna conductor 1 as far as possible because the vertical portion of the high band antenna conductor 2 is a portion to have the most significant effect on receiving sensitivity in the high receiving frequency band. Specifically, it is preferable that the vertical portion of the high band antenna conductor is arranged to be apart from the vertical portion of the low band antenna conductor by not shorter than 200 mm.

From this viewpoint, the embodiments shown in FIGS. 17 and 19 are preferable among the structures of the antenna conductors shown in FIGS. 10–19 with respect to receiving signals in the high receiving frequency band.

In the glass antenna device shown in FIGS. 10–19, it is preferable that the low band antenna conductor 1 which is arranged in a space (an upper space) above the defogger in the glass sheet has a conductor width of 0.2–5 mm. When the conductor width is less than 0.2 mm, production is difficult. If the conductor width is more than 5 mm, the antenna conductor is an obstacle to a visual field, which creates a problem in terms of safety.

In FIGS. 10–19, the low band antenna conductor 1 and the high band antenna conductor 2 are arranged in the upper space above the defogger. However, provision of the antenna conductors is not limited to such a position. The low band antenna conductor 1 and the high band antenna conductor 2 may be arranged in a space (a lower space) below the defogger in the glass sheet.

When the low band antenna conductor 1 is used to receive signals in a frequency band of less than 10 MHz, it is preferable that when the low band antenna conductor 1 is arranged in the upper space or the lower space of the glass sheets the total length of the low band antenna conductor 1 is not shorter than 7 $m/m^2$ under the conditions that the low band antenna conductor has a conductor width of 0.2–5 mm. It is more preferable that the total length is not shorter than 20 $m/m^2$. The total length of not shorter than 7 $m/m^2$ gives higher receiving sensitivity than the total length of less than 7 $m/m^2$ by several dB. The total length of not shorter than 20 $m/m^2$ gives higher receiving sensitivity than the total length of less than 20 $m/m^2$ by several dB.

When the low band antenna conductor 1 is used to receive signals in a frequency band less than 10 MHz, it is preferable that the low band antenna conductor 1 has a portion or most portions thereof separated from the vehicle opening by not shorter than 10 mm. The separation of not shorter than 10 mm can improve receiving sensitivity by normally more than about 4 dB in comparison with the separation of less than 10 mm.

Even if the low band antenna conductor 1 has a portion or most portions thereof separated from the vehicle opening by not shorter than 10 mm, it is preferable that the low band antenna conductor 1 has a portion or most portions thereof separated from a grounding conductor by not shorter than 10 mm when the glass sheet has the grounding conductor arranged to be connected to a vehicle ground.

When the high band antenna conductor 2 is used for receiving signals in a frequency band of not lower than 10 MHz, it is preferable that the high band antenna conductor 2 is close to the defogger to be capacitively coupled to the defogger. The presence of the capacitive coupling can improve receiving sensitivity in the frequency band of not shorter than 10 MHz by normally more than about 5 dB in comparison with lack of the capacitive coupling.

With regard to the capacitive coupling between the high band antenna conductor 2 and the defogger, the high band antenna conductor 2 and the defogger are capacitively coupled to have a distance of normally about 0.1 mm–about 50 mm. The distance of less than 0.1 mm makes production difficult. The distance of longer than about 50 mm is too long to easily obtain capacitive coupling in the frequency band of not lower than 10 MHz.

In FIGS. 10–19, there is provided a capacitive coupling element which is substantially in a T-character shape, and the high band antenna conduct 2 is close to the capacitive coupling element 34 to capacitively couple the high band antenna conductor 2 and the defogger. However, the capacitive coupling between the high band antenna conductor and the defogger is not limited to such arrangement. The capacitive coupling may be made by putting the high band antenna conductor 2 directly near to a heater strip 32 at the highest position. The shape of the capacitive coupling element 34 is not limited to such a T-character one, and the capacitive coupling element may be substantially in an L-character shape and so on.

In FIGS. 10–19, the high band antenna conductor 2 has a lower portion (a portion near to the capacitive coupling element 34) formed substantially in a reversed T-character shape. However, the form of the lower portion is not limited to such a shape. The high band antenna conductor 2 may have the lower portion made of a conductor pattern substantially in an L-character shape or the likes and the conductor pattern may be put directly near to the heater strip 32 or a bus bar to establish the capacitive coupling. Establishment of the capacitive coupling is not limited to such measures, and may be made by other measures.

When the high band antenna conductor 2 is used for receiving signals in the frequency band of not lower than 10 MHz, it is preferable that the high band antenna conductor 2 has a portion or most portions thereof separated from the vehicle opening in a range of from 20 mm to 60 mm. The separation in such a range can improve receiving sensitivity by normally more than 3 dB in comparison with the separation outside such a range.

In the present invention, the vehicle opening means an opening of a vehicle in which the glass sheet is fitted, which works as the vehicle ground, and which is made of an electrically conductive material such as metal. Although in the embodiments shown in FIGS. 10–19, the low band antenna conductor 1 and the high band antenna conductor 2 have no auxiliary antenna conductor annexed thereto, the present invention is not limited to such embodiments. The conductor pattern or the feeding terminal for each antenna conductor has an auxiliary antenna conductor annexed thereto substantially in a T-character shape, an L-character shape and so on in order to carry out phase adjustment and directivity adjustment, In the present invention, the number of the antenna conductors which are provided on an automobile is not limited. Diversity reception may be carried out between a glass antenna device according to the present invention and at least one selected among other antennas such as a pole antenna and other glass antennas.

The diversity reception will be described in detail. The glass antenna device according to the present invention means a glass antenna device which adopts at least one of the arrangements shown in FIGS. 1 and 4. The embodiments shown in FIGS. 3 and 6 are also included. A first structure of the diversity reception is that a stronger signal is among a plurality of signals received in a plurality of glass antenna devices according to the present invention. The received signals correspond to signals at the positions denoted by "to receiving set" in FIGS. 1 and 4.

A second structure of the diversity reception is that a stronger signal is used among a signal received in one or a plurality of glass antenna devices according to the present invention, and at least one of signals received by other antennas such as a pole antenna and the other glass antenna.

In the diversity reception according to the present invention, a combination of the low band antenna conductor 1 and the high band antenna conductor 2 in a pair (the first pair of the antenna conductors) shown in FIGS. 1 and 4 is arranged in a single glass sheets and another combination of the low band antenna conductor and the high band antenna conductor in a pair (the second pair of the antenna conductor) may be arranged in the same glass sheet as the first pair of the antenna conductors or in a different glass sheet.

For example, there can be adopted arrangement wherein the first pair of the antenna conductors is arranged in a glass sheet for a rear side window at one side of a vehicle, and the second pair of the antenna conductors is arranged in a glass sheet for a rear side window at the other side of the vehicle.

When the present invention is applied to a glass sheet for a rear window with a defogger, the defogger is capacitively coupled to the high band antenna conductor 2 and there are provided a plurality of heat strips, the heater strips preferably have portions remote from bus bars short-circuited by a short-circuit line.

Although the single short-circuit line is acceptable, the short-circuit line may be divided into a two sections, i.e. a first short-circuit line 35 and a second short-circuit line 36 as shown in FIG. 10 or others. The short-circuit line may be divided into a plurality of sections, such as three sections or four sections. Dividing into two sections is more preferable.

The first short-circuit line 35 and the second short-circuit line 36 are provided as needed. When the defogger is used as an antenna, the first and second short-circuit lines function to stabilize the impedance of the defogger. The first short-circuit line 35 and the second short-circuit line 36 also function to cover broad-band. When there is not provided the capacitive coupling element 34, the first short-circuit line 35 and the second short-circuit line 36 may project or extend from the junctions (crossing portions) with the short-circuited heater strips 2, which is not shown in FIGS. 10–19.

In order to use the defogger as the antenna to the full, it is preferable that the ratio of the length $U_2$ of the second short-circuit line 36 to the length $U_1$ of the first short-circuit line 35 satisfies the inequality, $0.1 \leqq U_2/U_1 \leqq 3$. The ratio in such a range can improve the receiving sensitivity in a high frequency band by normally about 1 dB–about 3 dB in comparison with the ratio outside the range. An effect to cover broad-band can be also promoted by properly adjusting the length $U_1$ and the length $U_2$ at a such a ratio.

Although the first short-circuit line 35 and the second short-circuit line 36 are not required to be located at the center of the defogger in the horizontal direction, it is preferable that the short-circuit line 35 and the second short-circuit line 36 are arranged substantially at the center of the defogger in the horizontal direction to obtain good impedance matching. It is preferable that the first short-circuit line 35 and the second short-circuit line 36 cross the heat strips 2 at substantially right angles in order to minimize the flow of heating current in the first short-circuit line 35 and the second short-circuit line 36.

It is not required that the first short-circuit line 35 and the second short-circuit line 36 short-circuit all the heater strips 2. The first short-circuit line 35 and the second short-circuit line 36 may be constituted by a single short-circuit line. In such a case, it is not necessary to short-circuit all the heater strips 2.

In FIGS. 10–19, the feeding terminals 4 and 14 are arranged in a left peripheral portion of the glass sheet. However, the present invention is limited to such arrangement. The feeding terminals can be arranged at any portions on the glass sheet. For example, the feeding terminals may be arranged vertical peripheral portions at the centers in the right and left side of the sheet glass.

Although the defogger shown in FIGS. 7 and 10 in a ⋀-character shape, the defogger according to the present invention is not limited to the one having such a shape. Even if the defogger is in a ⊃-character shape as shown in FIG. 12, the defogger can be utilized in the present invention.

In the defogger shown in FIG. 12, the right one of the bus bars at both sides of the defogger is divided into two sections at a desired portion to provide a lower bus bar 5*a* and an upper bus bar 5*b*. The lower bus bar 5*a* is connected to a lead of the vehicle ground, and the upper bus bar 5*b* is connected to a lead at the anode side of the direct current source. A fed current flows from the upper bus bar 5*b* to the lower bus bar 5*a* through the bus bar 5*c* in the ⊃-character shape.

As the glass sheet 31 shown in FIG. 19, a tempered glass sheet or a laminated glass sheet normally having a thickness of about 3–5 mm is usually used. The glass sheet 31 has an inner side formed with a region to be heated. In the region, there is provided the electric heating type defogger 33 which includes a plurality of the heater strips and opposed bus bars connected to both ends of a group of the heater strips. The bus bars of the defogger 33 are connected to leads. The defogger 33 shown in FIG. 19 is constituted by the heater strips 32 and the bus bars. The heater strips 32 are normally constituted by forming a number of the electric heating type thin heater strips having a width of 0.5–2 mm on the glass sheet in the lateral direction in parallel with intervals of 2–4 cm.

The bus bars are formed at opposite ends of the heater strips 32 in order to feed a current to the heater strips. The heater strips, the bus bars, the low band antenna conductor 1 and the high band antenna conductor 2 are normally prepared by printing paste including a conductive metal such as electric conductive silver paste on an interior side of the glass sheet, followed by baking.

The pattern of the high band antenna conductor 2 is not specialized to be directed to AM broadcast or FM broadcast. The pattern can be properly selected and designed so as to obtain the optimum performance as an antenna for AM broadcasts FM broadcast, radio broadcast in AM and FM, or other broadcast such as TV broadcast, depending on the size and shape of an automobile, and the shape, size and structure of a glass sheet.

In FIG. 19, the low band antenna conductor 1 and the high band antenna conductor 2 are arranged in the upper space of the glass sheet 31. The position of the low band antenna conductor 1 and the high band antenna conductor 2 on the glass sheet 31 is not limited to the one shown in FIG. 19 as stated earlier. The antenna conductors may be arranged at the lower space of the glass sheet 31.

The antenna conductors may be arranged above and under the defogger 33, respectively. The antenna conductors may be arranged at an other space. The glass sheet 31 has another antenna conductor arranged thereon in addition to the low band antenna conductor 1 and the high band antenna conductor 2.

Although explanation has been made for the embodiment of FIG. 19 wherein the glass sheet 31 for a rear window with the defogger arranged therein is used, the glass sheets usable in the present invention are not limited to glass sheets for a rear window. The present invention is applicable to a glass sheet without a defogger, a glass sheet for a front windshield, a glass sheet for a front side windshield, a glass sheet for a rear side windshield and a glass sheet for a skylight.

When the glass sheet is constituted by a laminated glass sheet wherein a thermal insulating layer such as an air layer, a vacuum layer or a gas layer is interposed between a first glass sheet and a second glass sheet, the first glass sheet and the second glass sheet have the low band antenna conductor 1 and the high band antenna conductor 2 arranged thereon, respectively, to obtain efficient use of space, i.e. space saving.

Figure 20:
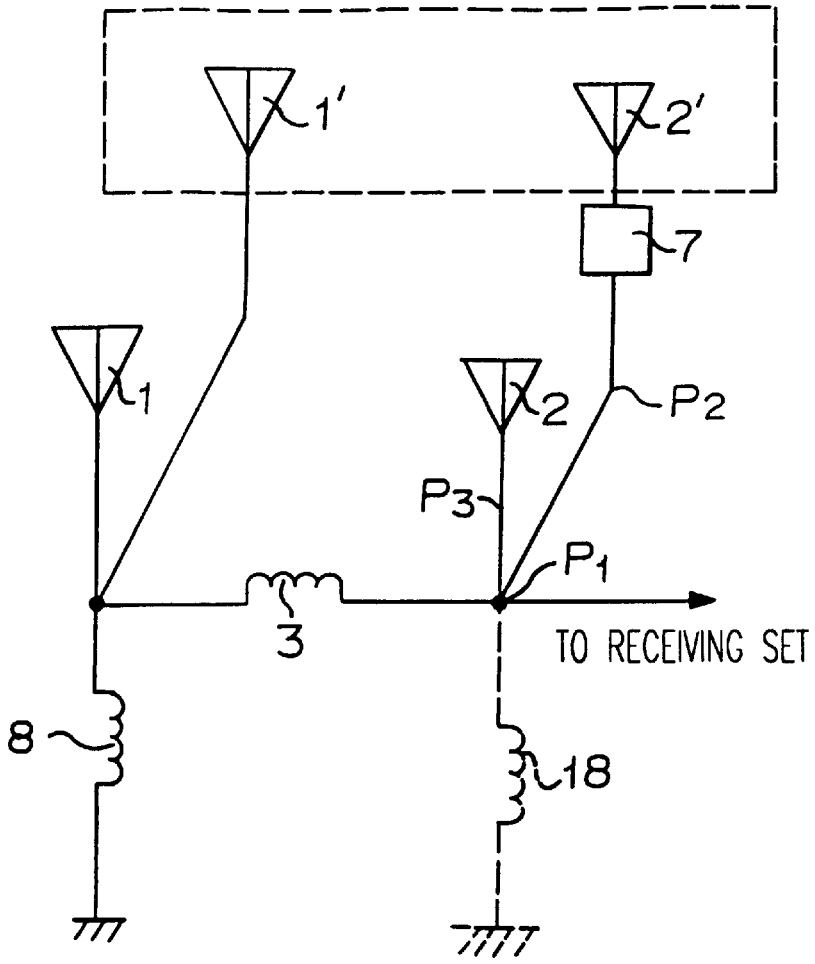
FIG. 20 is a schematic diagram of the basic structure of another embodiment of the present invention.

In FIG. 20, there is shown a circuit diagram of a basic structure, explaining the principle of another example of the present invention. In FIG. 20, reference numeral 1' designates another low band antenna conductor (hereinbelow, referred to as the second low band antenna conductor) which is apart from the low band antenna conductor 1. Reference numeral 2' designates another high band antenna conductor (hereinbelow, referred as to the second high band antenna conductor) which is apart from the high band antenna conductor 2. Reference numeral 7 designates a phase adjustment circuit which is provided as needed. Symbol $P_1$ designates a junction between the high band antenna conductor 2 and the second high band antenna conductor 2' or a point in the high band antenna conductor 2. Symbol $P_2$ designates a point in the second antenna conductor 2'. Symbol $P_3$ designates a point in the high band antenna conductor 2.

In Figures other than FIG. 20, the same reference numerals and symbols as the ones in FIG. 20 indicate similar or corresponding parts. In the explanation with respect to FIG. 20, the low band antenna conductor 1 in FIG. 20 is referred to as the first low band antenna conductor 1, and the high band antenna conductor 2 in FIG. 20 is referred to as the first high band antenna conductor 2. The space surrounded by the dotted line in FIG. 20 indicates a glass sheet which is apart from a glass sheet with the first low band antenna conductor 2 arranged thereon.

As an embodiment of the present invention, the first low band antenna conductor 1 and the second low band antenna conductor 1' may be connected together as shown in FIG. 20. The number of the low band antenna conductors to be connected together is unlimited. In other words, it is preferable that a plurality of the low band antenna conductors are provided to be connected together to improve receiving sensitivity.

The low band antenna conductors to be connected together may be provided on a single glass sheet or separate glass sheets. One or more of the low band antenna conductors on a glass sheet may be connected to one or more of the low band antenna conductors which are provided on a position except for the glass sheet. The connection of the plural low band antenna conductors as stated above is also applicable to the high band antenna conductors.

When the plural low band antenna conductors are connected together, it is not always necessary to provide the plural high band antenna conductors and connect them together, and it is acceptable to provide the single high band antenna conductor. Likewise, when the plural high band antenna conductors are connected together, it is not always necessary to provide the plural low band antenna conductors and to connect them together, and it is acceptable to provide the single low band antenna conductor.

Although the phase adjustment circuit 7 is not always necessary, the provision of the phase adjustment circuit allows the phase difference between the first high band antenna conductor 2 and the second high band antenna conductor 2' to be minimized. For this reason, the provision of the phase adjustment circuit 7 is preferable. The presence of the phase adjustment circuit 7 can improve receiving sensitivity in the high receiving frequency band by more than about 3 dB in comparison with the absence of the phase adjustment circuit 7. When the phase adjustment circuit 7 is not provided, the first high band antenna conductor 2 is connected directly to the second high band antenna conductor 2'.

The measures shown in FIG. 20 is also applicable to the circuit shown in FIG. 4. When the measures shown in FIG. 20 is applied to the circuit shown in FIG. 4, the junction between the first low band antenna conductor 1 and the second low band antenna conductor 1' is located between the first low band antenna conductor 1 and the third coil 18, and the junction between the first high band antenna conductor and the second high band antenna conductor 2' is located between the first high band antenna conductor 2 and the second coil 8, which is similar to the arrangement shown in FIG. 20.

Figure 21:
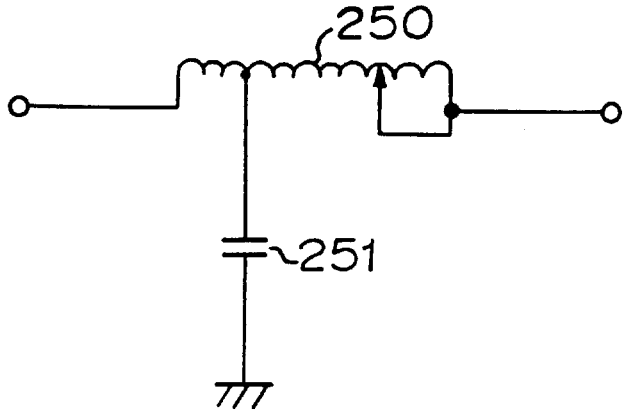
FIG. 21 is a schematic circuit diagram of a typical example of a phase adjustment circuit.

In FIG. 21 there is shown a circuit diagram of a typical example of the phase adjustment circuit 7. In FIG. 21, reference numeral 250 designates a variable coil, and reference numeral 251 designates a capacitor. As the variable coil 250, a variable coil of 33 nH to 1 $\mu$H is normally used. As the capacitor 251, a capacitor of 5–1,000 pF is usually adopted. The structure of the phase adjustment circuit 7 is not limited to the one shown in FIG. 21.

In the embodiment shown in FIG. 20, the number of the antenna conductors which are provided on an automobile is unlimited. Diversity reception may be carried out between the glass antenna device according to the present invention shown in FIG. 20, and other antennas such as a pole antenna and other glass antenna.

The diversity reception will be explained in detail. The glass antenna device shown in FIG. 20 according to the present invention includes a case wherein the embodiments shown in FIGS. 3, 4 and 6 are applied to the embodiment shown in FIG. 20.

A first structure of the diversity reception is that a strong signal is used among a plurality of signals received in a plurality of the glass antenna devices according to the present invention. The received signals corresponds to received signals at the position which is denoted by "to receiving set" in FIG. 20.

A second structure of the diversity reception is that a stronger signal is used among a signal received in one or more of the glass antenna devices according to the present invention, and at least one of signals received by other antennas such as a pole antenna and other glass antennas.

A third structure of the diversity reception is that the requirements of the first structure or the second structure of the diversity reception are satisfied, that the high band antenna conductor 2 and the high band antenna conductor 2' are not connected at the point $P_1$, and that on receiving a signal in the high receiving frequency band, a stronger signal is utilized among a received signal at the point $P_1$, a received signal at the point $P_2$, a received signal at the high band antenna conductor according to the present invention provided as needed, and a received signal at a high receiving frequency band antenna conductor which is different from the present invention and is provided as needed.

A fourth structure of the diversity reception is that the requirements of the first structure or the second structure of the diversity reception are satisfied as needed, that the high band antenna conductor 2 and the high band antenna conductor 2' are not connected at the junction $P_1$, that the point $P_3$ and the point $P_1$ in the high band antenna conductor 2 are not connected together, and that point $P_2$ and the point $P_3$ are connected to different input terminals of a switching circuit (not shown), respectively. The switching circuit has an output terminal connected to the point $P_1$. Under such connection, the switching circuit is controlled based on a selective signal from a receiving set to connect a stronger one of the received signals at the points $P_2$ and $P_3$ to the point $P_1$.

As the switching circuits either a mechanically controlled one such as relay, or a semiconductor controlled one such as an FET or a bipolar transistor may be adopted.

With respect to glass sheets on which the respective antenna conductors are provided, it may be possible to adopt a case wherein the first low band antenna conductor 1 and the first high band antenna conductor 2 are arranged on a glass sheet at one side of a vehicle, e.g. on a glass sheet for a rear side window, and that the second low band antenna conductor 1' and the second high band antenna conductor 2' are arranged on a glass sheet for a rear side window at the other side of the vehicle.

Figure 22:
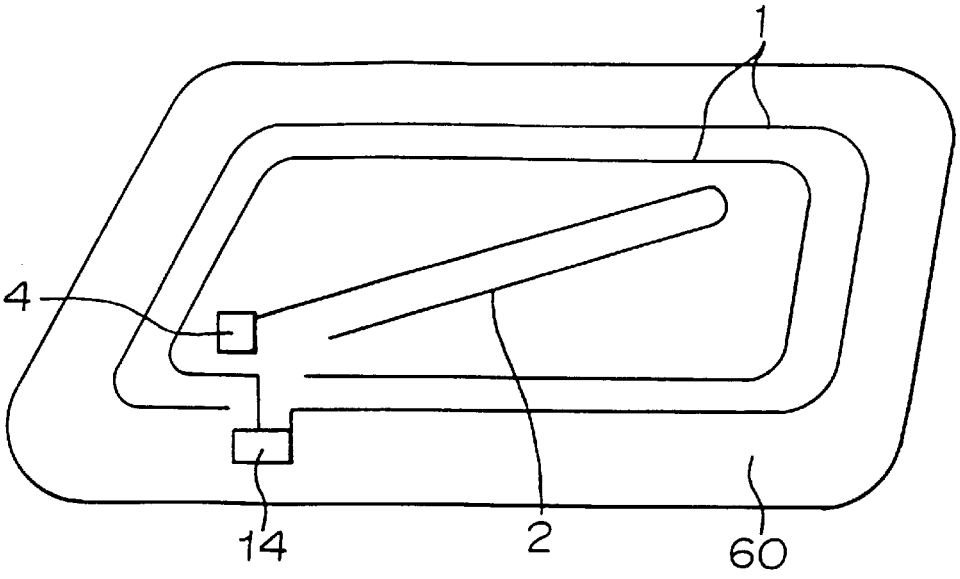
FIG. 22 is a schematic view showing an example of the antenna conductors wherein the present invention is applied to a glass sheet for a rear side window.

In FIG. 22, there is shown an example of the structure of the antenna conductors according to the present invention which are arranged on a glass sheet for a rear side windows In FIG. 22, reference numeral 60 designates the glass sheet.

In FIG. 22, the position of the feeding terminals 4 and 14 is almost unlimited in terms of receiving characteristics. However, it is desirable that the feeding terminals are provided as close as possible to a peripheral position of the glass sheet to ensure a visual field.

All the antenna conductors according to the present invention may be provided on a glass sheet at one side of a vehicles e.g. a glass sheet for a side windshield, having the arrangement shown in FIG. 20. The antenna conductors according to the present invention may be distributed on glass sheets for side windshields at both sides of a vehicles having the arrangement shown in FIG. 20.

When the antenna conductors are distributed on the glass sheets at both sides of the vehicle, it is preferable that diversity reception is carried out between the glass antennas on the glass sheets at both sides to improve directivity.

When the antenna device according to the present invention is arranged on a glass sheet for a side windshield, a glass sheet for a rear side windshield is particularly the best to prevent a visual field from lowering. Although explanation of the glass sheet in FIG. 19 has been made for the glass sheet for a rear window with the defogger arranged thereon. The present invention is not limited to such arrangement. The antenna device according to the present invention is also applicable to a glass sheet without a defogger. The antenna device according to the present invention is applicable to another glass sheets such as a front windshield, a side windshield and a skylight glass sheet.

Figure 26:
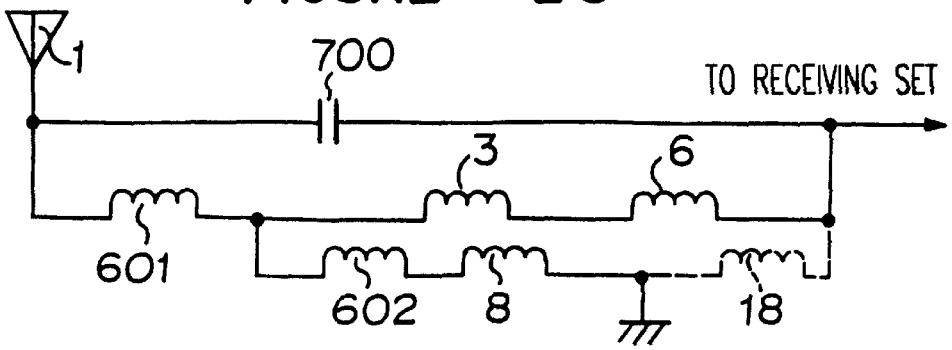
FIG. 26 is a schematic circuit diagram of the basic structure of a typical example wherein the present invention is simplified.

In FIG. 26, there is shown a typical example wherein the present invention is simplified. In FIG. 26, reference numeral 601 designates a second high frequency coil, reference numeral 602 designates a third frequency coil, and reference 700 designates a capacitor.

Figure 27:
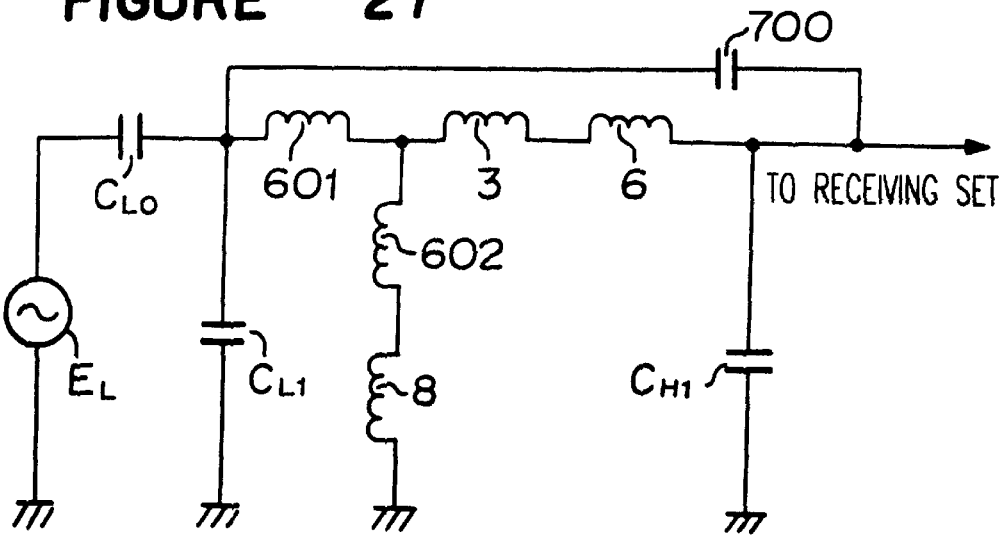
FIG. 27 is an equivalent circuit diagram of FIG. 26.
Figure 27:
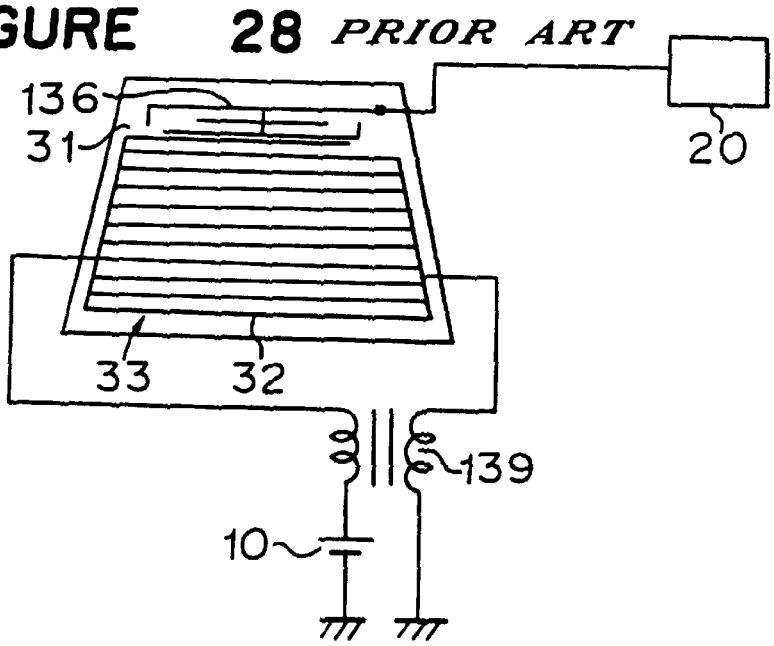

In FIG. 27 there is shown an equivalent circuit of FIG. 26. In FIGS. 26 and 27, the second high frequency coil 601 and the third high frequency coil 602 have the same electric property as the first high frequency coil 6. Although in FIGS. 26 and 27, the high band antenna conductor 2 shown in FIG. 1 is not provided, the basic functions of the circuit shown in FIGS. 26 and 27 is the same as those of the circuit shown in FIG. 1.

The low band antenna conductor 1 is used as an antenna conductor which can works for not only the low receiving frequency band but also the high receiving frequency band. In place of the low band antenna conductor 1, there may be provided an antenna conductor which is suitable for receiving signals in both the low receiving frequency band and the high receiving frequency band.

Between the low band antenna conductor 1 and the receiving set are connected the first coil 3 and the capacitor 700 in parallel. Like the embodiment of FIG. 1, the inductance value of the first coil is set to exhibits low impedance at least in the low receiving frequency band.

The capacitor 700 is set to have a capacitance value so that it exhibits low impedance in the high receiving frequency band and high impedance in the low receiving frequency band.

A received signal in the high receiving frequency band which has been induced in the low band antenna conductor 1 is transmitted to the receiving set through the capacitor 700. The capacitance value of the capacitor 700 is normally about 1–1,000 pF. For example, when the low receiving frequency band is an AM broadcast band and the high receiving frequency band is an FM broadcast band, it is preferable that the capacitance value of the capacitor 700 is in a range of 5.0–33 pF.

The second high frequency coil 601 and the third high frequency coil 602 are provided as needed, and they are used to avoid a case wherein a received signal in the high receiving frequency band which has been induced in the low band antenna conductor 1 leaks to the vehicle ground. Provision of either one of the second high frequency coil 601 or the third high frequency coil 602 is normally sufficient.

When the second high frequency coil 601 and the third high frequency coil 602 are provided and a signal in the low receiving frequency band is received, the second high frequency coil 601 and the third high frequency coil 602 exhibit low impedance. As the second high frequency coil 601 and the third high frequency coil 602e coils of about 0.1–100 $\mu$H are usually used.

The second high frequency coil 601 and the third high frequency coil 602 exhibit high impedance at least in the high receiving frequency band and its near region, and the second coil 6 normally has a low self resonant frequency and loses inductance in the high receiving frequency band. The second high frequency coil 601 or the third high frequency coil 602 can act for the second coil 8 in the high receiving frequency band.

If the second coil 8 can exhibit high impedance over a wide frequency band region from the low receiving frequency band to the high receiving frequency band by itself, the second high frequency coil 601 or the third high frequency coil 602 is not necessary and can be omitted.

The first coil 3 cooperates with a first other element to generate the first resonance so as to cause the first resonance to have a resonant frequency existing in a lower region than the high receiving frequency band.

The end of the capacitor 700 remote from the low band antenna conductor 1 is connected to the receiving set by a cable.

It is preferable that the second coil cooperates with a second other element to apparently generate the second resonance.

In FIG. 26, the second coil 8 is arranged at the position of the third coil 18 as shown in FIG. 4. In this case, the basic functions of the circuit are the same as those of the circuit shown in FIG. 4.

Utilization of the present invention which has improvement in receiving sensitivity as its main object will be explained.

Like the conventional device shown in FIG. 28, the glass sheet 31 for a rear windshield has the electric heating type defogger 33 arranged thereon so as to include the heater strips 32 and the bus bars for feeding power to the heater strips 32. The choke coil 139 is connected between bus bars and the direct current source 10 and between the bus bars and the vehicle ground. The choke coil 139 has impedance set to exhibit high impedance in a high frequency band region such as a broadcast frequency band region, thereby cutting off currents in the broadcast frequency band region from the direct current source 10 to the defogger 33.

Under such arrangement at least one of the low band antenna conductor 1 and the high band antenna conductor 2 is put close to the defogger for capacitive coupling. Signals received by the antenna conductor thus capacitively coupled makes stronger to improve receiving sensitivity.

When the low band antenna conductor or the antenna conductor for both the low band and the high band shown in FIG. 26 is close to the defogger 33 for capacitive coupling, receiving sensitivity can be improved in not only the low receiving frequency band but also the high receiving frequency band.

With regard to the measures to cut off the currents in the broadcast frequency band region into the defogger 33, the choke coil may be connected only between the bus bars and the direct current source 10, or only between the bus bars and the vehicle ground unlike the conventional device shown in FIG. 28.

EXAMPLES

Example 1

Preparation of a glass antenna device according to the present invention was planned for receiving signals in AM broadcast and FM broadcast. The low receiving frequency band corresponds to an AM broadcast frequency band and the high receiving frequency band corresponds to an FM broadcast frequency band. The glass antenna device was prepared so as to have the circuit shown in FIG. 3 and the conductor pattern shown in FIG. 19. There were provided the first short-circuit line 35, the second short-circuit line 36 and the capacitive coupling element 34.

As to the circuit shown in FIG. 3, the first coil 3, the second coil 8, the high frequency coil 6, the resistor 101, the resistor 103, the capacitor 120 and the coupling capacitor 19 were adopted for preparation. Other coil, resistors and capacitors were not provided. As the first coil 3, a chip coil which is effective in a relatively wide band region was used.

With respect to the value of each circuit element, the first coil 3 was 330 $\mu$H and the second coil 8 was 180 $\mu$H for the AM broadcast frequency band (500–1,500 kHz).

For the FM broadcast frequency band (88–108 MHz), the high frequency coil 6 was 1.0 $\mu$H. For the AM broadcast frequency band and the FM broadcast frequency band, the resistor 101 was 100 Ω, the resistor 103 was 3.6 KΩ, the capacitor 120 was 47 pF and the coupling capacitor 19 was 0.01 $\mu$F.

With regard to each dimension of the conductor pattern shown in FIG. 19, $L_1$ was 30 mm, $L_2$ was 10 mm, $L_3$ was 1,200 mm, $L_4$ was 400 mm, $L_5$ was 100 mm and $L_6$ was 125 mm.

The distance (capacitive coupled portion) between the lowest position of the high band antenna conductor 2 and the capacitive coupling element 34 was 3.0 mm, and the shortest distance between the low band antenna conductor 1 and a vehicle opening (the upper portion of a window) was about 20 mm. The maximum lateral width of the defogger was 1,400 mm, and the maximum vertical width of the defogger was 535 mm, 16 of heater strips are provided with intervals of 35 mm. The length of the first short-circuit line 35 was 245 mm, and the length of the second short-circuit line was 245 mm.

The active capacitance $C_{L0}$ of the low band antenna conductor 1 was about 10 pF, the floating capacitance $C_{L1}$ of the low band antenna conductor 1 was about 50 pF, and the reactive capacitance $C_{L0}$ of the high band antenna conductor 2 was about 8 pF. The capacitance $C_{H1}$ as the sum of the floating capacitance of the high band antenna conductor 2 and the floating capacitance of a cable (not shown) was about 155 pF.

Figure 23:
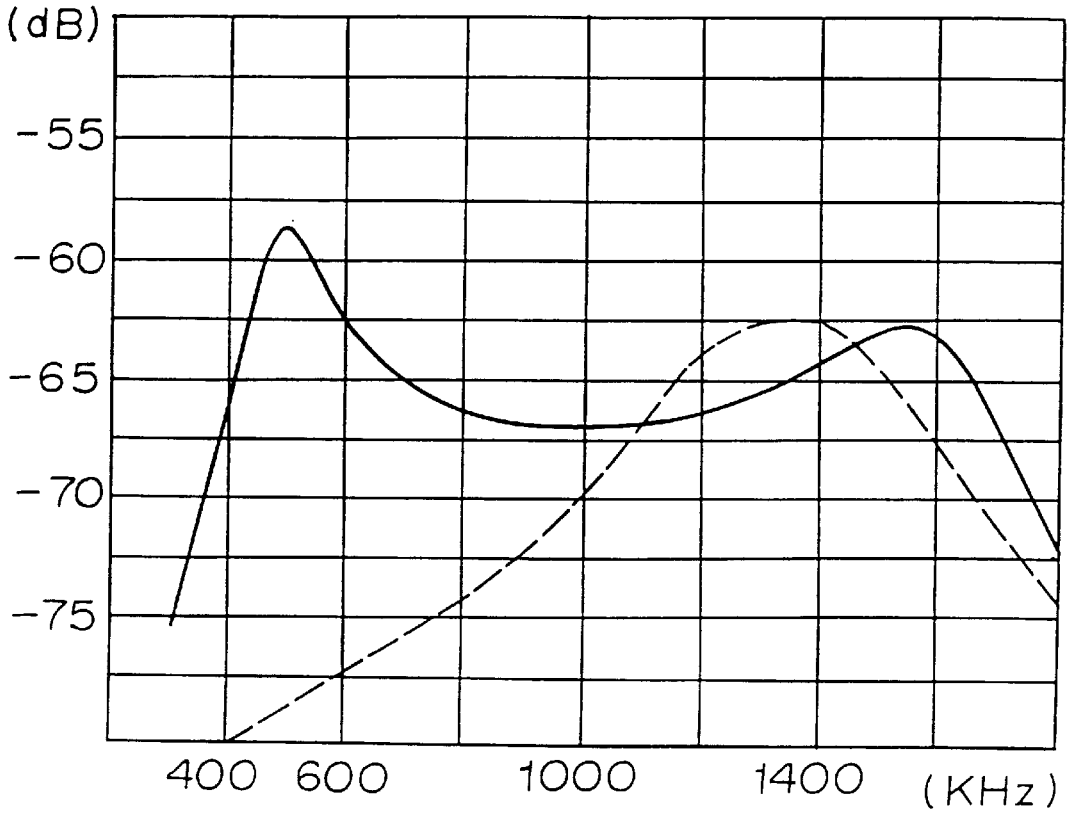
FIG. 23 is a graph showing the characteristic curves of the receiving sensitivity and the receiving frequency in Examples 1 and 2.

The results about the AM broadcast frequency band are shown in a solid line in FIG. 23. In FIG. 23, a pole antenna having a length of 500 mm exhibits about −65 dB. With regard to the FM broadcast frequency band, the antenna device was able to have substantially the same performance (within ±2 dB) as the pole antenna having a length of 500 mm.

In FIG. 23, the resonant frequency of the first resonance was about 700 kHz the resonant frequency of the second resonance was about 1,200 kHz, the first subordinate resonant frequency of the second resonance was about 500 kHz, and the second subordinate resonant frequency of the second resonance was about 1,580 kHz.

Example 2

It adopted the same structure as the one of the Example 1 except for absence of the second coil 8 and the capacitor 20. The results about the AM broadcast frequency band is shown in a dotted line in FIG. 23. Comparison with the Example 1 indicates that the Example 1 was superior in terms of flatness in receiving sensitivity and average receiving sensitivity over the entire AM broadcast frequency band as shown in FIG. 23. The results about the FM broadcast frequency band were the same as the ones of the Example 1.

In FIG. 23, the resonant frequency of the first resonance was about 700 kHz, the resonant frequency of the parallel resonance which was generated by the first resonance was about 1,370 kHz.

Example 3

There were provided neither the capacitive coupling element 34, nor the first short-circuit line 35, nor the second short-circuit line 36. The high band antenna conductor 2 was not capacitively coupled to the defogger. the other structure was the same as that of Example 1. The results about the AM broadcast frequency band are shown in the solid line in FIG. 23, which was the same as those of Example 1. The results about the FM broadcast frequency band showed that the average receiving sensitivity in the FM broadcast frequency band was inferior to the Example 1 by about 6 dB.

Example 4

Although there was provided the capacitive coupling element 34, there were provided neither the short-circuit line 35 nor the second short-circuit line 36. The other structure was the same as that of the Example 1. The results about the AM broadcast band are shown in the solid line in FIG. 23, which were the same as those of the Example 1. The results about the FM broadcast frequency band showed that the average receiving sensitivity in the FM broadcast frequency band was superior to the Example 3 by about 4.0 dB.

Example 5

All heater strips were connected by a single short-circuit line without dividing the short-circuit line into the first short-circuit line 35 and the second short-circuit line 36. The length of the single short-circuit line was 525 mm. The other structure was the same as that of Example 1.

The results about the AM broadcast frequency band are shown in the solid line in FIG. 23, which were the same as those of Example 1. The results about the FM broadcast frequency band showed that the average receiving sensitivity in the FM broadcast frequency band was superior to the Example 3 by about 4.5 dB.

Example 6

4 of heater strips in total from the heater strip at the highest position to the one at the fourth highest position were connected by the first short-circuit line 35. 12 of heater strips in total from the heater strip at the fifth highest position to the one at the lowest position were connected by the second short-circuit line 36. The length of the first short-circuit line 35 was 105 mm, and the length of the second short-circuit line 36 was 385 mm. The other structure was the same as that of the Example 1.

The results about the AM broadcast frequency band were shown in the solid line in FIG. 23, which were the same as those of the Example 1. The results about FM broadcast frequency band indicated that the average receiving sensitivity in the FM broadcast frequency band was superior to the Example 3 by about 4.5 dB.

Example 7

12 of heater strips in total from the heater strip at the highest position to the one at the twelfth highest position were connected to the first short-circuit line 35. 4 of heater strips in total from the heater strip at the thirteenth highest position to the one at the lowest position were connected by the second short-circuit line 36. The length of the first short-circuit line 35 was 385 mm, and the length of the second short-circuit line 36 was 105 mm. The other structure was the same as that of the Example 1. The results about the a broadcast frequency band are shown in the solid line in FIG. 23, which were the same as those of the Example 1. The results about the FM broadcast frequency band were also the same as those of Example 1.

Example 8

14 of heater strips in total from the heater strip at the highest position to the one at the fourteenth highest position were connected by the first short-circuit line 35. 2 of heater strips in total from the heater strip at the fifteenth highest position to the one at the lowest position were connected by the second short-circuit line 36. The length of the first short-circuit line was 455 mm, and the length of the second short-circuit line 36 was 35 mm. The other structure was the same as that of the Example 1. The results about the AM broadcast frequency band are shown in the solid line in FIG. 23, which were the same as those of the Example 1. The results about the FM broadcast frequency band indicated that the average receiving sensitivity in the FM broadcast frequency band was superior to the Example 3 by about 4.5 dB.

Example 9

There was provided the same structure as that of the Example 1 except that the low-pass filter 50 which had a cut-off region in the low receiving frequency band was connected between the defogger 33 and the direct current source 10 as shown in FIG. 7.

The coils 41 and 42 in the low-pass filter 50 were 0.93 $\mu$H, and the capacitor 43 was 2 $\mu$H (see FIG. 8). As the coils 41 and 42, coils had a diameter of 16 mm to allow a high current to flow. The self resonant frequency of the coils 41 and 42 was 100 MHz. As the capacitor 43, a ceramic capacitor was used, its self resonant frequency was 3 MHz, and its dielectric dissipation factor was 0.01 at 1 kHz.

The low-pass filter was located at a pillar portion near to a bus bar. The length of a lead which extends from the low-pass filter to a terminal of the bus bar was about 80 mm.

Comparisons with the Example 1 about the AM broadcast frequency band indicated that engine noise was decreased by 17 dB maximum and 10 dB minimum, that the average receiving sensitivity in the entire AM broadcast frequency band was the same as that of the Example 1, and that S/N ratio was improved by 13 dB at an average.

The results about the AM broadcast frequency band indicated that the receiving sensitivity and the S/N ratio were the same as those of the Example 1.

Example 10

Preparation of a glass antenna device according to the present invention was planned for receiving signals in AM broadcast and FM broadcast. The low receiving frequency band corresponds to the AM broadcast frequency band, and the high receiving frequency band corresponds to the FM broadcast frequency band. The glass antenna device was prepared so as to have the circuit shown in FIG. 6 and the conductor pattern shown in FIG. 19. There were provided the first short-circuit line 35, the second short-circuit line 36 and the capacitive coupling element 34.

In the circuit shown in FIG. 6, the first coil 3, the second coil 8, the high frequency coil 65 the resistor 203, the resistor 205 and the coupling capacitor 19 were adopted for preparation. Other coils, resistors and capacitors were not provided. As the first coil 3, a chip coil which is effective in a relatively wide band region was used.

As to the value of each circuit element, the first coil 3 was 330 $\mu$H and the second coil 8 was 330 $\mu$H in the AM broadcast frequency band (500–1,500 kHz).

In the FM broadcast frequency band (88–108 MHz), the high frequency coil 6 was 1.0 $\mu$H. In the AM broadcast frequency band and the FM broadcast frequency band, the resistor 203 was 6.8 kΩ, the resistor 205 was 12 kΩ and the coupling capacitor 19 was 0.01 $\mu$H.

The respective sizes in the conductor pattern shown in FIG. 19 were the same as those of the Example 1.

Figure 24:
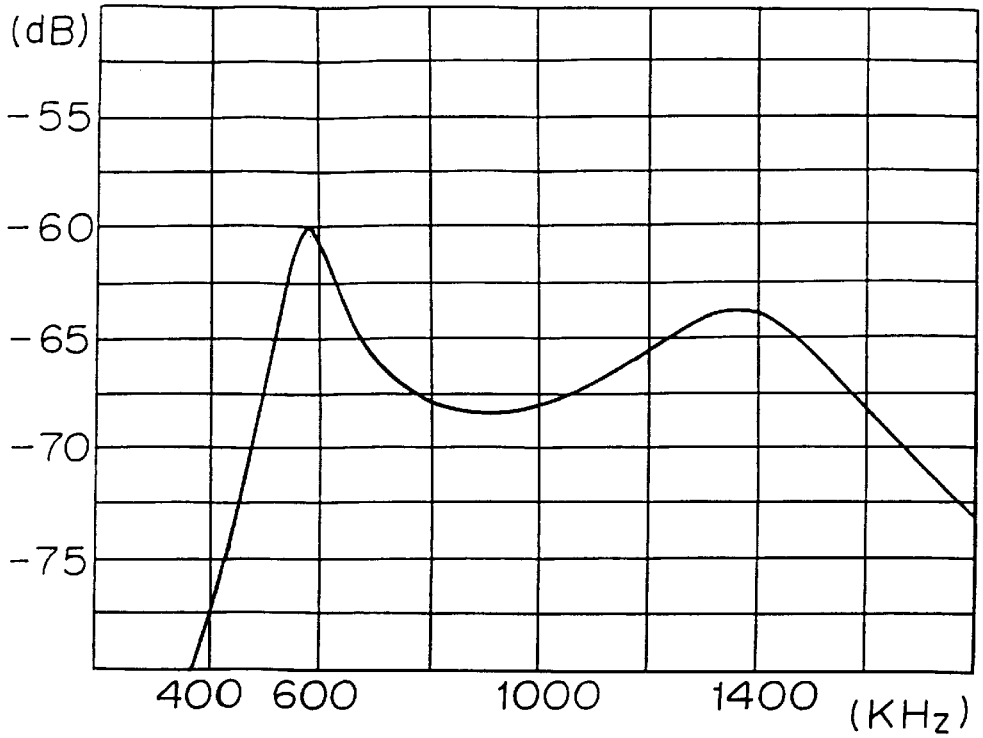
FIG. 24 is a graph showing the characteristic curve of the receiving sensitivity and the receiving frequency in Example 10.

The results about the AM broadcast frequency band are shown in FIG. 24. The results about the FM broadcast frequency band indicated that the Example 10 had substantially the same characteristics as the Example 1.

Example 11

Referring now to the circuit shown in FIG. 3, the first coil 3, the second coil 8, the high frequency coil 6, the third coil 18e the resistor 103, the capacitor 121 the coupling capacitor 19 were adopted for preparation. Other coils, resistors and capacitors were not provided. As the first coil 3, a chip coil which was effective in a relatively wide region was used.

As to the value to each circuit element, the first coil 3 was 470 $\mu$H, the second coil was 390 $\mu$H and the third coil 18 was 220 $\mu$H in the AM broadcast frequency band (500–1,500 kHz).

In the FM broadcast frequency band (88–108 MHz), the high frequency coil 6 was 1.0 $\mu$H. In the AM broadcast frequency band and the FM broadcast frequency bands the resistor 103 was 6.8 kΩ the capacitor 121 was 68 pF and the coupling capacitor 19 was 0.01 $\mu$H.

The other structure was the same as that of the Example 1.

Figure 25:
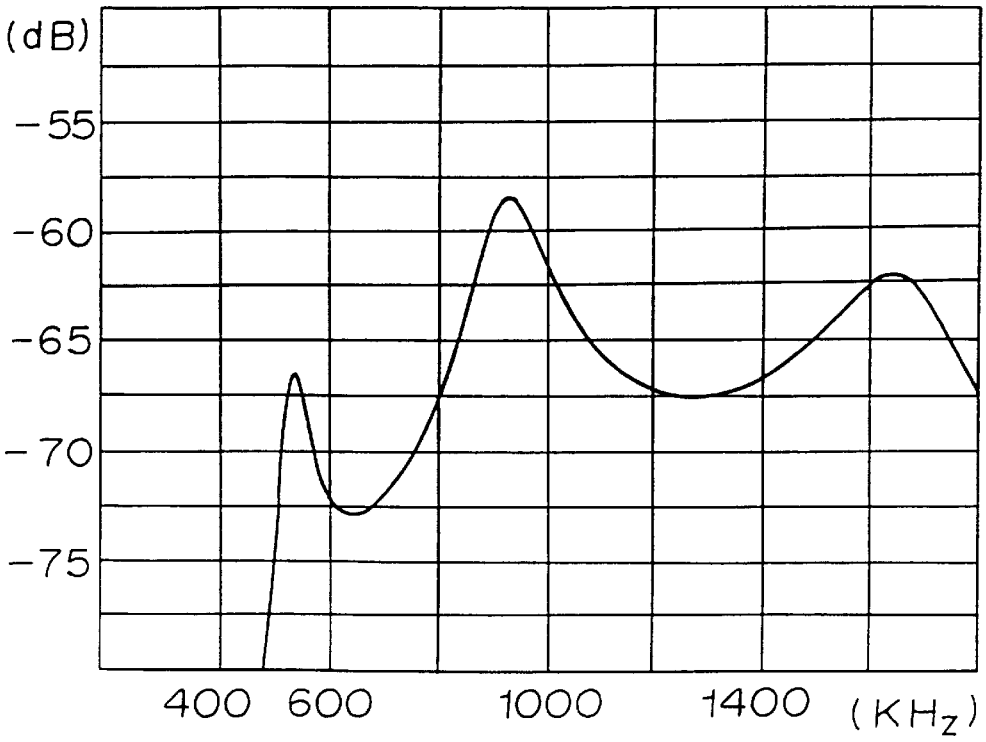
FIG. 25 is a graph showing the characteristic curve of the receiving sensitivity and the receiving frequency in Example 11.

The results about the AH broadcast frequency band are shown in FIG. 25. Comparisons with the Example 1 indicated that the Example 11 was superior to the Example 1 in terms of flatness in the receiving sensitivity and the average receiving sensitivity over the entire AM broadcast frequency band. The results about the FM broadcast frequency band were the same as those of the Example 1.

In accordance with the present invention the first coil exhibits low impedance on receiving signals in the low receiving frequency band to connect the low band antenna conductor and the high band antenna conductor. As a results the high band antenna conductor also works as a part of the low band antenna conductor, improving receiving sensitivity in the low receiving frequency band.

The inductance of the first coil and mainly the floating capacitance of the low band antenna conductor generate the first resonance, and the resonant frequency of the first resonance exists at a frequency lower than the high receiving band. The first resonance can further improve receiving sensitivity in a desired low receiving frequency band.

In accordance with the present inventions the second coil can be used to generate the second resonance, thereby to improve receiving sensitivity in a desired low receiving frequency band and to receive signals, having good flatness.

When the present invention is applied to a glass sheet for a rear windshield with a defogger, the defogger can not be used as an antenna on receiving signals in the low receiving frequency band. As a results a large-sized choke coil is not required for the defogger, which contributes compaction of the glass antenna device and improvement in producibility.

In accordance with the present invention, when the high band antenna conductor is put close to the defogger for capacitive coupling, receiving sensitivity can be improved in a high receiving frequency band of not lower than 10 MHz such as an FM broadcast band even if no choke coil is connected between the defogger and the vehicle ground.

In accordance with the present invention, the antenna conductor for the AM broadcast band and the antenna conductor for the FM broadcast band may be prevented from being separately arranged at a glass sheet on an automobile unlike the glass sheet antenna device. As a result, the area occupied by the antenna conductors on the glass sheet is small, minimizing a problem such as narrowness in a visual field.

When the low band antenna conductor and the high band antenna conductor are separately on a glass sheet on an automobile to receive signals in the low receiving frequency band, both the low band antenna conductor and the high band antenna conductor can be used to improve receiving sensitivity in the low receiving frequency band, offering effective reception.

What is claimed is:

1. A glass antenna device for a vehicle, comprising:

a glass sheet to be fitted to a window opening of a vehicle, which has a first antenna conductor for a low receiving frequency band and a second antenna conductor for a high receiving frequency band arranged on the glass sheet;

a first coil electrically connected between the first antenna conductor and the second antenna conductor, the first coil having an inductance value which exhibits low impedance in at least the low receiving frequency band; and a second coil electrically connected between one of the first antenna conductor and the second antenna conductor, and a vehicle body ground;

wherein the first coil cooperates with a first other element to generate first resonance so that the first resonance has a resonant frequency lower than the high receiving frequency band;

wherein the second coil cooperates with a second other element to apparently generate second resonance;

wherein the second resonance improves receiving sensitivity in a region of the low receiving frequency band.

2. A glass antenna device for a vehicle according to claim 1 wherein the inductance value of the first coil is set to exhibit high impedance in at least the high receiving frequency band.

3. A glass antenna device for a vehicle according to claim 1, wherein the second antenna conductor is electrically connected to a receiving set by a cable to transmit a signal in the second antenna conductor to the receiving set.

4. A glass antenna device for a vehicle according to claim 3, wherein the first other element comprises capacitance which is a sum of floating capacitance of the second antenna conductor and floating capacitance of a cable.

5. A glass antenna device for a vehicle according to claim 1, wherein the first resonance introduces parallel resonance by reactance due to series connection of an element comprising capacitance as a sum of floating capacitance of the second antenna conductor, and floating capacitance of a cables and the first coil, and by an element comprising floating capacitance of the first antenana conductor.

6. A glass antenna device for a vehicle according to claim 5, wherein the parallel resonance has a resonant frequency existing in the low receiving frequency band.

7. A glass antenna device for a vehicle according to claim 1, wherein the second other element includes floating capacitance of the first antenna conductor.

8. A glass antenna device for a vehicle according to claim 1, wherein an element which comprises a component exhibiting high impedance in a wide frequency band region from a frequency higher than the low receiving frequency band to the high receiving frequency band is used in place of the first coil.

9. A glass antenna device for a vehicle according to claim 1, wherein a circuit element which comprises an inductance component and includes at least one of a capacitance component and a resistance component is used in place of the first coil.

10. A glass antenna device for a vehicle according to claim 1, wherein a circuit which comprises the first coil and a high frequency coil electrically connected in series with the first coil is used in place of the first coil.

11. A glass antenna device for a vehicle according to claim 1, wherein a third coil is electrically connected between a vehicle ground and one of an end of the first antenna conductor and an end of the second antenna conductor which is free of electrical connection with the second coil, and wherein inductance of the third coil and an element which comprises capacitance as a sum of floating capacitance of the second antenna conductor and floating capacitance of a cable apparently generate a third resonance.

12. A glass antenna device for a vehicle according to claim 1, wherein the first resonance and the apparently generated second resonance cause first subordinate resonance and second subordinate resonance, wherein when a maximum frequency of the low receiving frequency band is defined as $f_H$, the first subordinate resonance has a resonant frequency existing between a frequency of 1.5 times $f_H$ and a substantially center frequency of the low receiving frequency band, and wherein when a minimum frequency of the low receiving frequency band is defined as $f_L$, the second subordinate resonance has a resonant frequency existing between a frequency of 0.6 times $f_L$ and a substantially center frequency.

13. A glass antenna device for a vehicle according to claim 1, wherein when a center frequency of the low frequency band is defined as $f_M$, the first resonant has a resonance frequency existing between a frequency of 0.6 times $f_M$ and a frequency of 1.4 times $f_M$, and the apparently generated second resonance has a resonance frequency existing between a frequency of 0.6 times $f_M$ and a frequency of 1.4 times $f_M$.

14. A glass antenna device for a vehicle according to claim 1, wherein the glass sheet has an electric heating type defogger arranged on the glass sheet, the defogger having a plurality of heater strips and a plurality of bus bars for applying power to the plurality of heater strips, the plurality of bus bars connected to a d.c. source; and wherein the second antenna conductor is close to the defogger for capacitive coupling.

15. A glass antenna device for a vehicle according to claim 14, wherein at least one portion of the second antenna conductor is arranged between the first antenna conductor and the defogger.

16. A glass antenna device for a vehicle according to claim 14, wherein at least one of the plurality of heater strips is connected at portions remote from the plurality of bus bars by a first short-circuited line, and at least one of the remaining strips is short-circuited at portions remote from the pilurality of bus bars by a second short circuited line.

17. A glass antenna device for a vehicle, comprising:

a glass sheet to be fitted to a window opening of a vehicle, which has an antenna conductor arranged on the glass sheet, wherein the antenna conductor is effective in a low receiving frequency band and a high receiving frequency band;

a first coil and a capacitor which are electrically connected in parallel being electrically connected between the antenna conductor and a receiving set, the first coil having an inductance value which exhibits low impedance in at least the low receiving frequency band, and the capacitor having a capacitance value which exhibits low impedance in the high receiving frequency band and high impedance in the low receiving frequency band; and a second coil electrically connected between the antenna conductor and a vehicle body ground;

wherein the first coil cooperates with a first other element to generate first resonance so that the first resonance has a resonant frequency lower than the high receiving frequency band, and an end of the capacitor remote from the antenna conductor is electrically connected to the receiving set by a cable;

wherein the second coil cooperates with a second other element to apparently generate second resonance;

wherein the second resonance improves receiving sensitivity in a region of the low receiving frequency band.

18. A glass antenna device for a vehicle according to claim 17, wherein the second coil is electrically connected between one of an end of the capacitance remote from the antenna conductor and an end of the cable, and the vehicle body ground.

19. A glass antenna device for a vehicle according to claim 17, wherein a third coil is electrically connected between an end of the capacitance remote from the antenna conductor or an end of the cable and a vehicle ground, and wherein inductance of the third coil and an element which comprises capacitance as a sum of floating capacitance of the antenna conductor and floating capacitance of the cable apparently generate third resonance.

20. A glass antenna device for a vehicle according to claim 17, wherein the glass sheet has an electric heating type defogger arranged on the glass sheet, the defogger having a plurality of heater strips and a plurality of bus bars for applying power to the plurality of heater strips; a choke coil is electrically connected at least one of between the plurality of bus bars and a d.c. source and between the purality of bus bars and a vehicle body ground; and at least one of the first antenna conductor and the second antenna conductor is close to the defogger for capacitive coupling.

21. A glass antenna device for a vehicle according to claim 17, wherein the glass sheet has an electric heating type defogger arranged on the glass sheet, the defogger having a plurality of heater strips and a plurality of bus bars for applying power to the plurality of heater strips; a choke coil is electrically connected at least one of between the plurality of bus bars and a d.c. source and between the plurality of bus bars and a vehicle body ground; and the antenna conductor is close to the defogger for capacitive coupling.

* * * * *